US012291415B2

(12) United States Patent
Takemura

(10) Patent No.: US 12,291,415 B2
(45) Date of Patent: May 6, 2025

(54) SHEET STORAGE APPARATUS AND SHEET PROCESSING APPARATUS

(71) Applicant: Glory Ltd., Himeji (JP)

(72) Inventor: Yoichi Takemura, Hyogo (JP)

(73) Assignee: GLORY LTD., Himeji (JP)

( * ) Notice: Subject to any disclaimer, the term of this patent is extended or adjusted under 35 U.S.C. 154(b) by 185 days.

(21) Appl. No.: 17/944,192

(22) Filed: Sep. 14, 2022

(65) Prior Publication Data

US 2023/0077663 A1 Mar. 16, 2023

(30) Foreign Application Priority Data

Sep. 16, 2021 (JP) ..... 2021-151141

(51) Int. Cl.
*B65H 31/02* (2006.01)
*B65B 5/10* (2006.01)
(Continued)

(52) U.S. Cl.
CPC ..... *B65H 31/02* (2013.01); *B65B 5/106* (2013.01); *B65B 35/50* (2013.01); *B65H 29/46* (2013.01);
(Continued)

(58) Field of Classification Search
CPC . B65B 35/50; B65B 5/106; B65H 2301/4212; B65H 2301/42142;
(Continued)

(56) References Cited

U.S. PATENT DOCUMENTS 4,872,303 A * 10/1989 Johnson ..... B65B 7/06 53/481
5,881,539 A 3/1999 Fukuda et al.
(Continued)

FOREIGN PATENT DOCUMENTS

DE 102009053155 A1 * 5/2011 ..... B65B 25/14
JP H0577805 A 3/1993
(Continued)

OTHER PUBLICATIONS

Machine translation of DE 10 2009 053 155 A1 (Year: 2011).*
Extended European Search Report issued Feb. 15, 2023, in corresponding European Patent Application No. 22195845.7.

*Primary Examiner* — Anna K Kinsaul
*Assistant Examiner* — Himchan Song
(74) *Attorney, Agent, or Firm* — XSENSUS LLP

(57) ABSTRACT

The sheet storage apparatus of the present disclosure includes an attachment unit to which a storing bag for sheets is attached; a holding unit that holds the sheets toward an inner side in a storage direction of the storing bag attached to the attachment unit, the sheets being stacked and stored in the storing bag; and a closing unit that closes an entrance of the storing bag by sandwiching the storing bag from outside thereof. The closing unit closes the entrance by moving from a first position to a second position, the first position being a position before the closing unit starts sandwiching the storing bag, the second position being a position when the closing unit sandwiches the storing bag. The closing unit passes through the inner side in the storage direction than the first position between moving from the first position to the second position.

15 Claims, 25 Drawing Sheets

(51) Int. Cl.
*B65B 35/50* (2006.01)
*B65H 29/46* (2006.01)

(52) U.S. Cl.
CPC ..... *B65H 2301/4212* (2013.01); *B65H 2301/422548* (2013.01); *B65H 2701/1912* (2013.01)

(58) Field of Classification Search
CPC ..... B65H 2301/422548; B65H 2701/1912; B65H 29/46; B65H 31/02; B65H 31/06; G07D 11/12; G07D 11/125
See application file for complete search history.

(56) References Cited

U.S. PATENT DOCUMENTS 9,117,323 B2 * 8/2015 Brexel ..... G07D 11/12
9,129,463 B2 * 9/2015 Langhuber ..... G07D 11/125
10,046,873 B2 8/2018 Razzaboni et al.
2009/0113852 A1 * 5/2009 Cecil ..... B29C 66/83543 53/481
2016/0031574 A1 * 2/2016 Razzaboni ..... B65H 29/46 53/268
2018/0305048 A1 10/2018 Nishimura et al.
2019/0122477 A1 4/2019 Yokoo
2019/0279453 A1 * 9/2019 Yokoo ..... B65H 29/46
2020/0353698 A1 * 11/2020 Shimoda ..... B29C 65/7894

FOREIGN PATENT DOCUMENTS

JP 2007302347 A 11/2007
JP 2010155640 A 7/2010
JP 2018181137 A 11/2018
JP 2019079109 A 5/2019

* cited by examiner

SHEET STORAGE APPARATUS AND SHEET PROCESSING APPARATUS

CROSS-REFERENCE TO RELATED APPLICATION

This application claims priority to Japanese Patent Application No. 2021-151141, filed on Sep. 16, 2021, the disclosure of which is incorporated herein by reference in its entirety.

TECHNICAL FIELD

The present disclosure relates to a sheet storage apparatus that stores sheets and to a sheet processing apparatus comprising the sheet storage apparatus.

BACKGROUND ART

A sheet storage apparatus that stores sheets, such as valuable paper or banknotes, in a storing bag is being widely used. For example, PTL 1 discloses an apparatus that sends a banknote into a bag disposed sideways and that stacks the banknote in a standing state inside the bag.

CITATION LIST

Patent Literature

PTL 1
U.S. Pat. No. 9,129,463

SUMMARY

A sheet storage apparatus of the present disclosure comprises: an attachment unit to which a storing bag for sheets is attached; a holding unit that holds the sheets toward an inner side in a storage direction of the storing bag attached to the attachment unit, the sheets being stacked and stored in the storing bag; and a closing unit that closes an entrance of the storing bag by sandwiching the storing bag from outside thereof, wherein the closing unit closes the entrance by moving from a first position to a second position, the first position being a position before the closing unit starts sandwiching the storing bag, the second position being a position when the closing unit has sandwiching the storing bag, and passes through a position closer to the inner side in the storage direction than the first position between moving from the first position to the second position.

DESCRIPTION OF EMBODIMENTS

Figure 1:
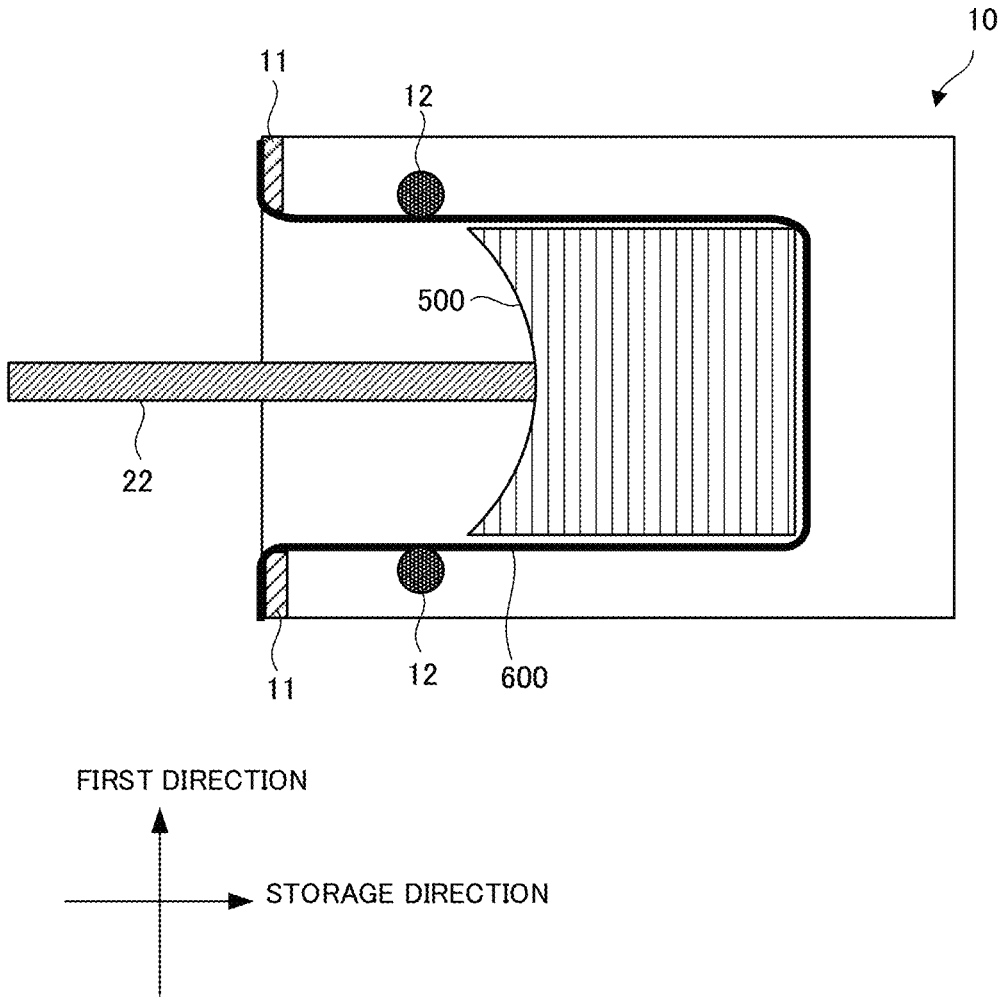
FIG. 1 shows a structure comprised in a sheet storage apparatus according to Embodiment 1 of the present disclosure.

PTL 1 discloses a structure in a thin-wall transport container that stores banknotes. In the structure, when the transport container is filled with banknotes, two closing elements provided at a frame that holds the transport container move while facing each other, and are connected by being snapped into each other, to thereby close the transport container.

In the technology disclosed in PTL 1, the transport container is filled with banknotes by a force applied by a stacking wheel. When the closing elements close the transport container, there is nothing in particular that supports the banknotes. Therefore, when part of the banknotes fall or are bent while the closing elements move while facing each other, such banknotes may be jammed between the closing elements.

In such a case, there is a possibility that the transport container cannot be closed due to the jammed banknotes.

In view of such circumstances, the present disclosure provides a sheet storage apparatus and a sheet processing apparatus, which are capable of preventing sheets from being jammed when closing a storing bag.

A sheet storage apparatus of the present disclosure comprises: an attachment unit to which a storing bag for sheets is attached; a holding unit that holds the sheets toward an inner side in a storage direction of the storing bag attached to the attachment unit, the sheets being stacked and stored in the storing bag; and a closing unit that closes an entrance of the storing bag by sandwiching the storing bag from outside thereof, wherein the closing unit closes the entrance by moving from a first position to a second position, the first position being a position before the closing unit starts sandwiching the storing hag, the second position being a position when the closing unit sandwiches the storing bag, and wherein passes through a position closer to the inner side in the storage direction than the first position between moving from the first position to the second position.

In the sheet storage apparatus of the present disclosure, the second position may be situated at an innermost side in the storage direction among positions of the closing unit from when the closing unit starts sandwiching the storing bag to when the closing unit completes sandwiching the storing bag.

In the sheet storage apparatus of the present disclosure, the closing unit may comprise a first closing unit and a second closing unit, and when the closing unit closes the entrance, the first closing unit and the second closing unit may approach each other and sandwich the storing bag.

In the sheet storage apparatus of the present disclosure, the holding unit may hold the sheets at an intermediate position in a direction in which the first closing unit and the second closing unit approach each other, and as the closing unit approaches the intermediate position, the closing unit may move toward the inner side in the storage direction.

In the sheet storage apparatus of the present disclosure, the holding unit may be a rod-shaped member or a plate-shaped member extending along the storage direction.

In the sheet storage apparatus of the present disclosure, the holding unit may be configured to hold down at least a portion excluding two end portions of the sheets that are stored in the storing bag. The holding unit may be configured in a plate shape extending in a left-right direction in the middle of an up-down direction of sheets to be held. At this time, the first closing unit and the second closing unit approach each other in the up-down direction and close the entrance of the storing bag. When the first closing unit and the second closing unit move in the direction in which they approach each other, and close the entrance, the holding unit retracts to an outer side in the storage direction relative to the entrance before the first closing unit and the second closing unit come into contact with each other. Thus, it is possible to hold, while not interrupting an operation of the closing unit, the sheets before the entrance is closed so as to prevent the sheets from falling, while not interrupting an operation of the closing unit.

The sheet storage apparatus of the present disclosure may further comprise: a sealing unit that is disposed closer to an outer side in the storage direction than the closing unit, and that sandwiches and seals the storing bag from the outside thereof with the entrance closed by the closing unit.

In the sheet storage apparatus of the present disclosure, the closing unit and the sealing unit may sandwich the storing bag by moving in response to each other.

In the sheet storage apparatus of the present disclosure, the sealing unit may comprise a first sealing unit and a second sealing unit, and when the sealing unit seals the storing bag, the first sealing unit and the second sealing unit may move so as to approach each other, and sandwich the storing bag.

In the sheet storage apparatus of the present disclosure, the sealing unit may move from a third position to a fourth position, the third position being a position before the sealing unit starts sandwiching the storing bag, the fourth position being a position when the sealing unit sandwiches the storing bag, and the third position and the fourth position may be the same in the storage direction.

In the sheet storage apparatus of the present disclosure, the closing unit may comprise a covering unit that covers the sealing unit, and the sealing unit may be covered at the third position by the covering unit of the closing unit that is at the first position, and may be exposed from the covering unit due to the closing unit moving to the second position in response to movement of the sealing unit toward the fourth position.

The sheet storage apparatus of the present disclosure may further comprise: a control unit that controls the closing unit and the sealing unit, and wherein, when a distance between a position of the sealing unit in the storage direction and a position where the holding unit holds down the sheets is less than or equal to a threshold distance, the control unit may cause sealing of the storing bag performed by using the closing unit and the sealing unit to be started.

In the sheet storage apparatus of the present disclosure, the closing unit may comprise a body portion that moves along a guide groove when sandwiching the storing bag.

In the sheet storage apparatus of the present disclosure, the closing unit may further comprise a contact portion that is engaged with the body portion, and when the closing unit sandwiches the storing bag, the contact portion may come into contact with the storing bag before the body portion comes into contact with the storing bag.

In the sheet storage apparatus of the present disclosure, the closing unit may further comprise a rotating shaft with which the contact portion is engaged, and the contact portion may rotate around the rotating shaft due to the body portion moving along a guide groove.

In the sheet storage apparatus of the present disclosure, when the body portion moves to the inner side in the storage direction, the contact portion rotates around the rotating shaft and thereby moves to the inner side in the storage direction relative to the body portion.

In the sheet storage apparatus of the present disclosure, a portion of the contact portion that comes into contact with the storing bag is formed with a shape without a corner.

A sheet processing apparatus of the present disclosure comprises: a receiving unit that receives sheets; and the above-described sheet storage apparatus that stores the sheets that have been received.

According to the present disclosure, it is possible to prevent sheets from being jammed when closing the storing bag.

Embodiments of the present disclosure are described in detail below with reference to the drawings. However, detailed descriptions that are more than is necessary, such as detailed descriptions of matters that are already well known and overlapping descriptions of structures that are substantially the same, may not be given. Structures that are common in the embodiments are given the same reference numerals, and overlapping descriptions thereof may not be given.

Embodiment 1

FIG. 1 shows a structure comprised in a sheet storage apparatus according to Embodiment 1 of the present disclosure. As shown in FIG. 1, a sheet storage apparatus 1 comprises attachment units 11, closing units 12, and a holding unit 22.

Each attachment unit 11 is a unit to which a storing bag 600 for storing sheets 500 is attached. The sheet storage apparatus 1 comprises a pair of attachment units 11. Note that the sheets 500 are, for example, sheets having predetermined sizes, such as banknotes or valuable paper. The plurality of sheets 500 are stacked and stored in a body portion of the storing bag 600. In the description below, a direction from one of the attachment units 11 toward the other of the attachment units 11 is a first direction. A direction in which the sheets 500 move when they are being stored in the storing bag 600, that is, a direction toward an inner side from an entrance: of the storing bag 600 is a storage direction. The first direction and the storage direction are orthogonal to each other. FIG. 1 is a sectional view of the sheet storage apparatus 1 along a plane orthogonal to the first direction and the storage direction.

An entrance portion of the storing bag 600 is attached to the attachment units 11. The body portion of the storing bag 600 is disposed so as to extend toward one side from the entrance portion attached to the attachment units 11.

The holding unit 22 applies a force along the storage direction to the sheets 500 stacked and stored inside the storing bag 600. This causes the sheets 500 to be held in a stacked state.

When the storing of the sheets 500 into the storing bag 600 has been completed, the closing units 12, before the sealing units 13 seal the entrance of the storing bag 600, close the entrance of the storing hag 600. The closing units 12 are disposed so as to sandwich the storing hag 600 from the outside of the storing bag 600. Until the storing of the sheets 500 into the storing bag 600 is completed, each closing unit 12 is positioned in a first position, where the entrance of the storing bag 600 is not closed; and, when the storing of the sheets 500 into the storing bag 600 is completed, each closing unit 12 moves to a second position, where the entrance of the storing bag 600 is closed. FIG. 1 shows each closing unit 12 in the first position.

Figure 2:
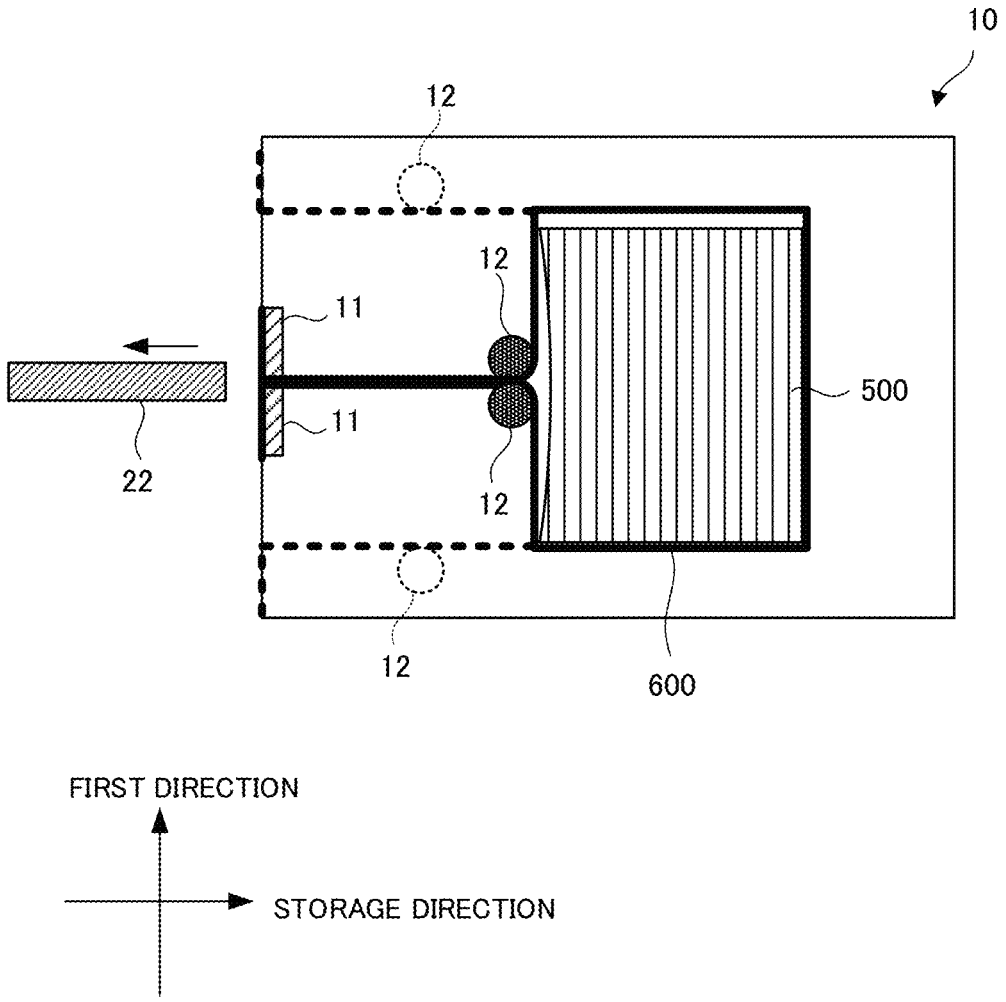
FIG. 2 shows the relationship between a first position and a second position of each closing unit in Embodiment 1.

FIG. 2 is a schematic view showing the relationship between the first position and the second position of each closing unit 12. FIG. 2 shows by broken lines the closing units 12 and the storing bag 600 when each closing unit 12 is in the first position, and shows by solid lines the closing units 12 and the storing bag 600 when each closing unit 12 is in the second position. Note that, while each closing unit 12 moves from the first position to the second position, the holding unit 22 stands by on an outer side in the storage direction.

As shown in FIG. 2, the second position is situated closer to the inner side in the storage direction than the first position. Therefore, when each closing unit 12 moves from the first position toward the second position, the closing units 12 passes through the inner side in the storage direction than the first position between moving from the first position to the second position.

Accordingly, according to the sheet storage apparatus according to Embodiment 1, during the time up to when the storing bag 600 is closed by the closing units 12, the sheets 500 that have been stored in the storing bag 600 are held by the holding unit 22. In the process of the closing units 12 closing the storing bag 600, the sheets 500 stored in the storing bag 600 come into contact with an inner surface of the storing bag 600 and are held by the inner surface. Therefore, when the storing bag 600 is closed by the closing units 12, the sheets 500 can be prevented from falling.

Embodiment 2

In Embodiment 2, the relationship between the position of a path of movement of each closing unit 12 and the position of the holding unit 22 is described in detail.

Figure 3:
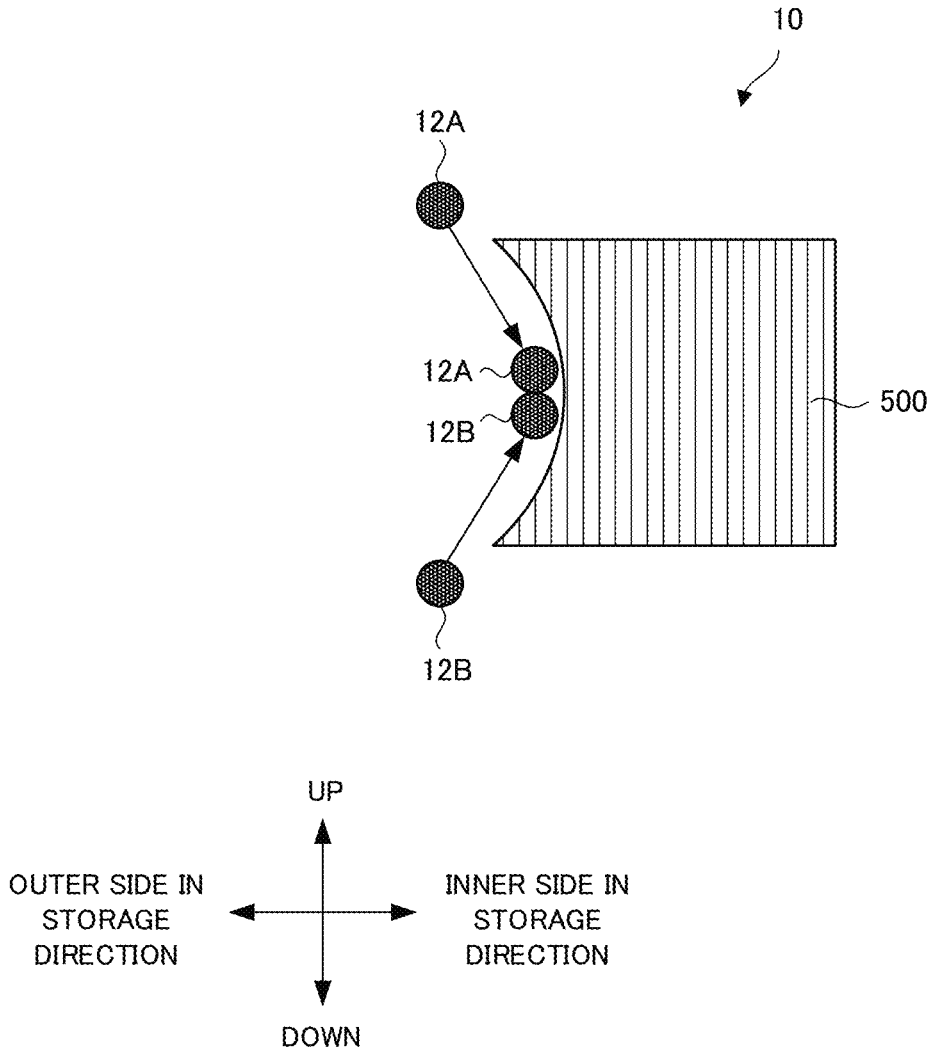
FIG. 3 shows examples of paths of movements of closing units in Embodiment 2.

FIG. 3 shows examples of the paths of movements of the closing units 12. FIG. 3 is a sectional view of a sheet storage apparatus 1 in a plane that is the same as that of FIG. 1. In the description below, a storing bag 600 is attached sideways to the sheet storage apparatus 1. "Sideways" refers to a state in which an entrance of the storing bag 600 faces a direction perpendicular to an up-down direction. Therefore, in the description below, a first direction in Embodiment 2 is a direction from a lower side toward an upper side when the sheet storage apparatus 1 is installed in a horizontal plane.

As shown in FIG. 3, the closing units 12 are a first closing unit 12A that is disposed above the storing bag 600 and a second closing unit 12B that is disposed below the storing bag 600. When the closing units 12 close the entrance of the storing bag 600, the first closing unit 12A and the second closing unit 12B approach each other to close the storing bag 600. The first closing unit 12A and the second closing unit 12B are closest to each other when the first closing unit 12A and the second closing unit 12B are positioned al an intermediate position in the up-down direction. The "intermediate position" in the up-down direction refers to an intermediate position when the first position of the first closing unit 12A and the first position of the second closing unit 12B are connected to each other by a straight line.

As shown in FIG. 3, as the first closing unit 12A and the second closing unit 12B approach the intermediate position, the first closing unit 12A and the second closing unit 12B move toward an inner side in a storage direction. Therefore, the second position is an innermost position in the storage direction in the paths of movements of the closing units 12 from when the closing units 12 start sandwiching the storing bag 600 to when the closing units 12 complete sandwiching the storing bag 600. Such paths of movements allow the storing bag 600 to be closed while avoiding the sheets 500 whose end portions have been bent as a result of being held by the holding unit 22.

Figure 4:
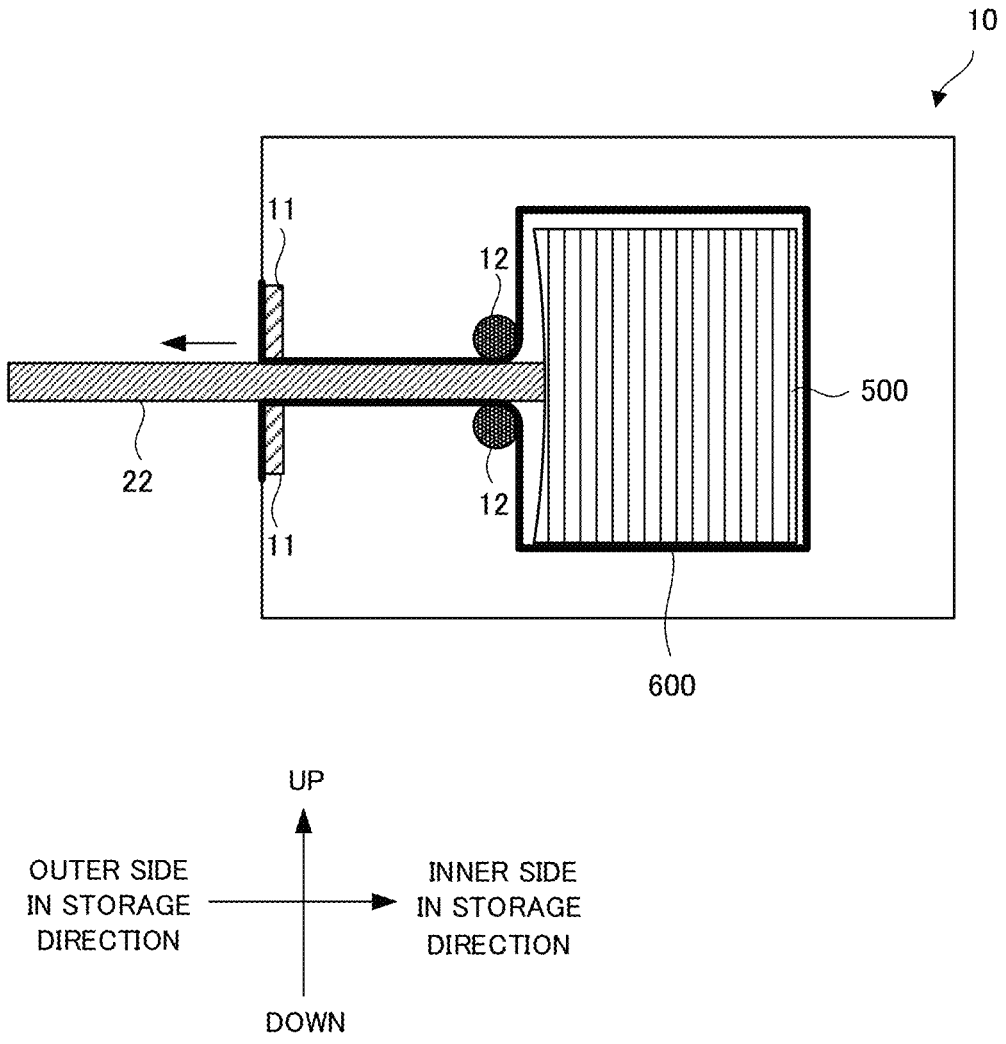
FIG. 4 shows a state just before a holding unit is pulled out of a storing bag with a first closing unit and a second closing unit being close to each other in Embodiment 2.

FIG. 4 is a schematic view showing a state just before the holding unit 22 is pulled out of the storing bag 600 with the first closing unit 12A and the second closing unit 12B being close to each other.

As shown in FIG. 4, the holding unit 22 holds the sheets 500 in the intermediate position in the up-down direction of the first closing unit 12A and the second closing unit 12B. As shown in FIG. 4, the holding unit 22 is a rod-shaped member or a plate-shaped member extending along the storage direction. The holding unit 22 is configured to hold down a portion excluding two end portions in the up-down direction of the sheets 500 stacked and stored in the storing bag 600. Therefore, as described above, the two end portions in the up-down direction of the sheets 500 may be bent as shown in FIG. 4.

FIG. 4 shows a state in which the entrance of the storing bag 600 is about to be closed as a result of the first closing unit 12A and the second closing unit 12B approaching each other. In this state, as shown in FIG. 4, the two end portions of the sheets 500 that have been bent by a force applied by the holding unit 22 may come into contact with the inner surface of the storing bag 600 whose entrance starts closing due to the first closing unit 12A and the second closing unit 12B. Therefore, subsequent to a point in time in FIG. 4, even if the holding unit 22 is pulled out of the storing bag 600 and the sheets 500 are no longer held by the holding unit 22, further bending of the two end portions of the sheets 500 is prevented by the inner surface of the storing bag 600.

In this way, according to the sheet storage apparatus 1 according to Embodiment 2, since, as the first closing unit 12A and the second closing unit 12B approach each other in the up-down direction, the first closing unit 12A and the second closing unit 12B move toward the inner side in the storage direction, the storing bag 600 can be closed while avoiding the sheets 500 whose two end portions have been bent by the holding unit 22.

Note that, although, in the description above, an example in which the first closing unit 12A and the second closing unit 12B move so as to approach each other is given, the present disclosure is not limited thereto. For example, the position of one of the closing units may be fixed. In this case, only the other of the closing units may move from the first position toward the second position so as to avoid the end portions of the sheets 500 that have been bent. In this case, the holding unit 22 may be disposed close to the fixed closing unit in the up-down direction instead of being disposed in the intermediate position in the up-down direction.

Figure 5:
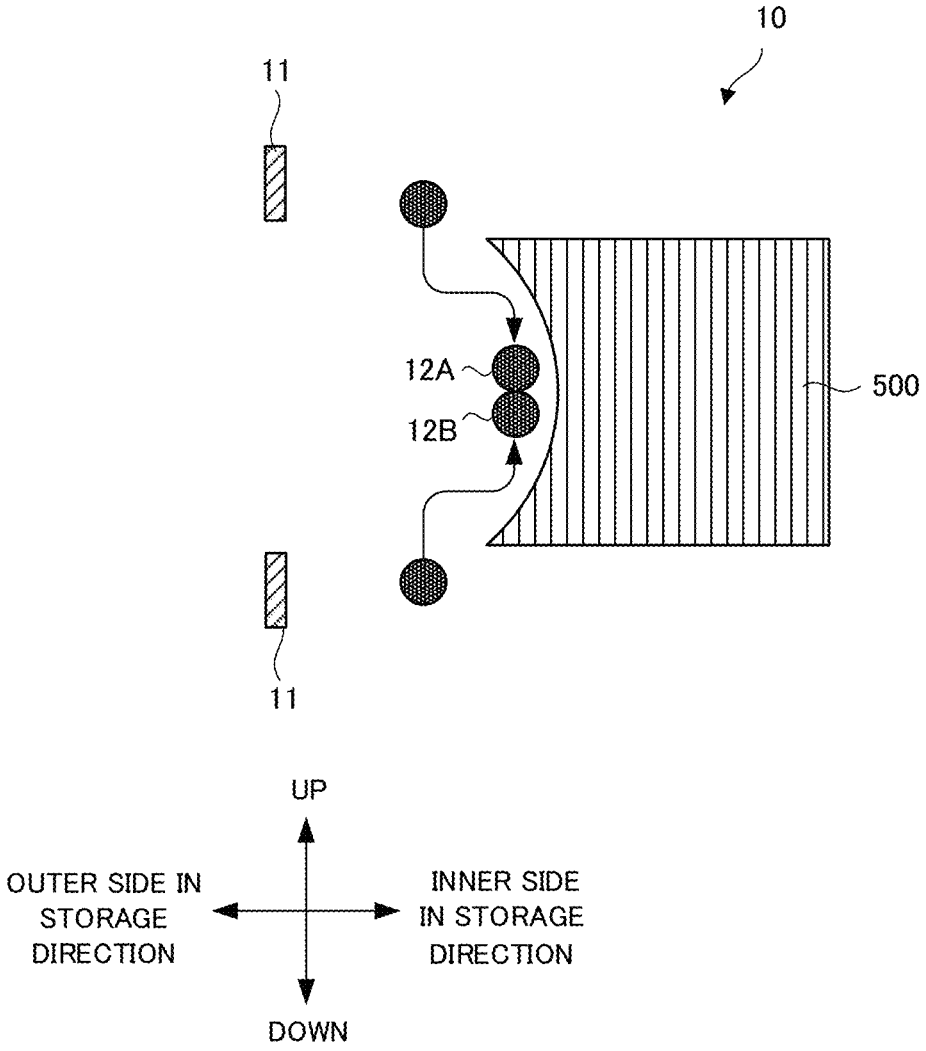
FIG. 5 shows other examples of paths of movements of the closing units in Embodiment 2.

Although, in the description above, an example in which the first closing unit 12A and the second closing unit 12B each move in straight lines from the first position to the second position is described, the present disclosure is not limited thereto. For example, as shown in FIG. 5, the first closing unit 12A and the second closing unit 12B may each move in a crank-shaped path of movement from the first position toward the second position. In this way, by adjusting the shapes of the paths of movements of the closing units 12, the closing units 12 can be expected to efficiently avoid the sheets whose end portions have been bent. The path of movement of the first closing unit 12A and the path of movement of the second closing unit 12B may have shapes that are symmetrical on the upper and lower sides, or may not have symmetrical shapes.

As described above, in Embodiment 2, since the closing units 12 move so as to avoid the sheets 500 that have been bent, the closing units 12 are capable of closing the storing bag 600 while avoiding the sheets 500 whose two end portions have been bent by the holding unit 22. Therefore, for example, it is no longer necessary to further push and compress the sheets 500 toward the inner side in the storage direction or displace an initial position of each closing unit 12 toward an outer side in the storage direction, and the sheets 500 can be prevented from being jammed when closing the storing bag 600. Consequently, jamming of the sheets at a portion of the storing bag 600 to be closed can be efficiently prevented.

Embodiment 3

In Embodiment 3, sealing units 13 that seal a storing bag 600 closed by closing units 12 are described.

Figure 6:
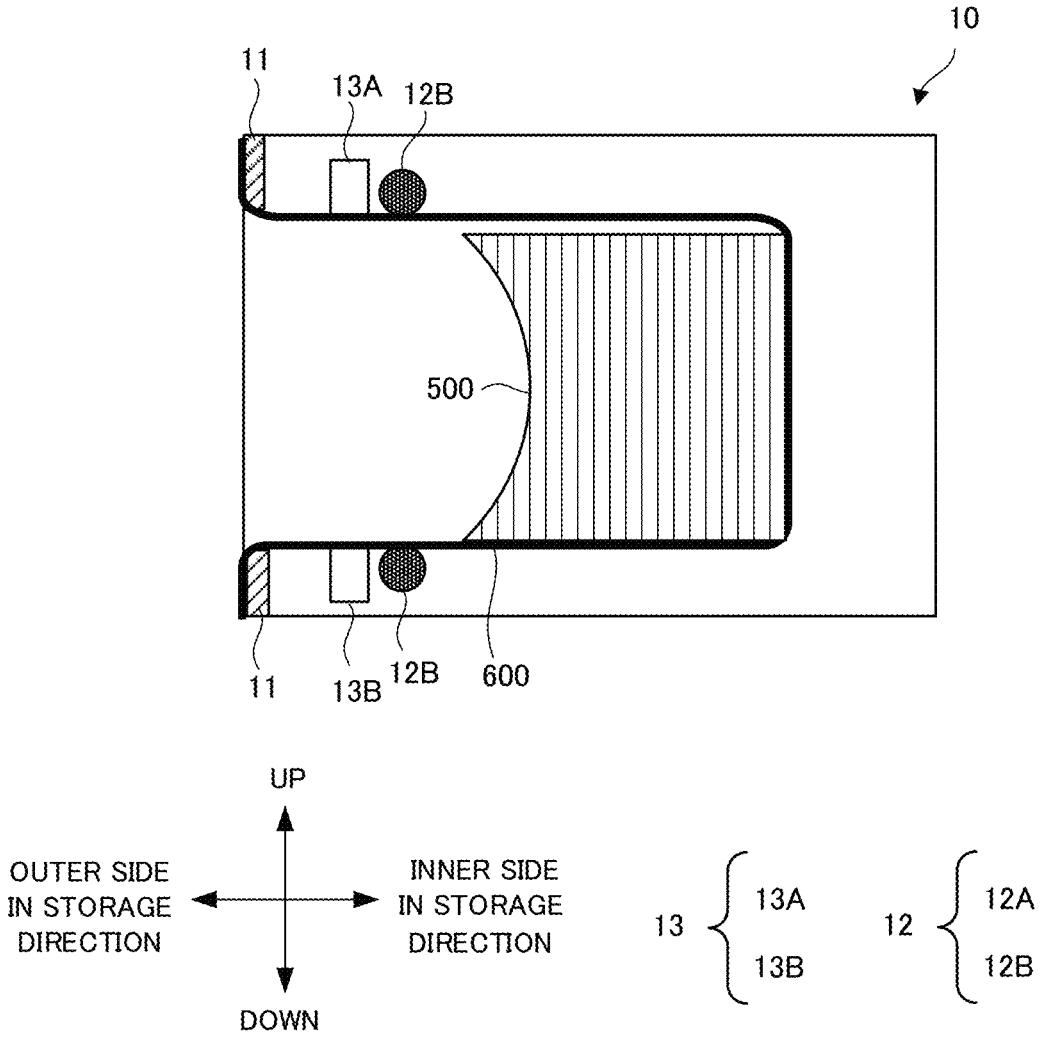
FIG. 6 shows a structure comprised in a sheet storage apparatus according to Embodiment 3.

FIG. 6 shows a structure comprised in a sheet storage apparatus according to Embodiment 3 of the present disclosure. As shown in FIG. 6, a sheet storage apparatus 1 comprises attachment units 11, closing units 12, sealing units 13, and a holding unit 22.

The sealing units 13 sandwich and seal from the outside the storing bag 600 closed by the closing units 12. The sealing units 13 are disposed closer to an outer side in a storage direction than the closing units 12. Therefore, the sealing units 13 seal the storing bag 600 at a location that is closer to the outer side in the storage direction than the closing units 12. Consequently, the likelihood of unintended jamming of sheets 500 by the sealing units 13 can be reduced.

As a method of sealing the storing bag 600 by the sealing units 13, a known method can be used. For example, when an inner surface of at least an entrance portion of the storing bag 600 is made of resin or the like, the sealing units 13 are heaters and seal the storing bag 600 by applying heat. The sealing units 13 may seal the storing bag 600 by heating and pressure-bonding the entrance portion of the storing bag 600, or may seal the storing bag 600 by using an instrument, such as a stapler.

As shown in FIG. 6, the sealing units 13 are a first sealing unit 13A that is disposed above the storing bag 600 and a second sealing unit 13B that is disposed below the storing bag 600. When the sealing units 13 seal the entrance of the storing bag 600, the first sealing unit 13A and the second sealing unit 13B approach each other. An initial position of each of the first sealing unit 13A and the second sealing unit 13B is a third position where the entrance of the storing bag 600 is not closed. When the first sealing unit 13A and the second sealing unit 13B seal the storing bag 600, each of the first sealing unit 13A and the second sealing unit 13B moves so as to approach each other up to a fourth position.

Figure 7:
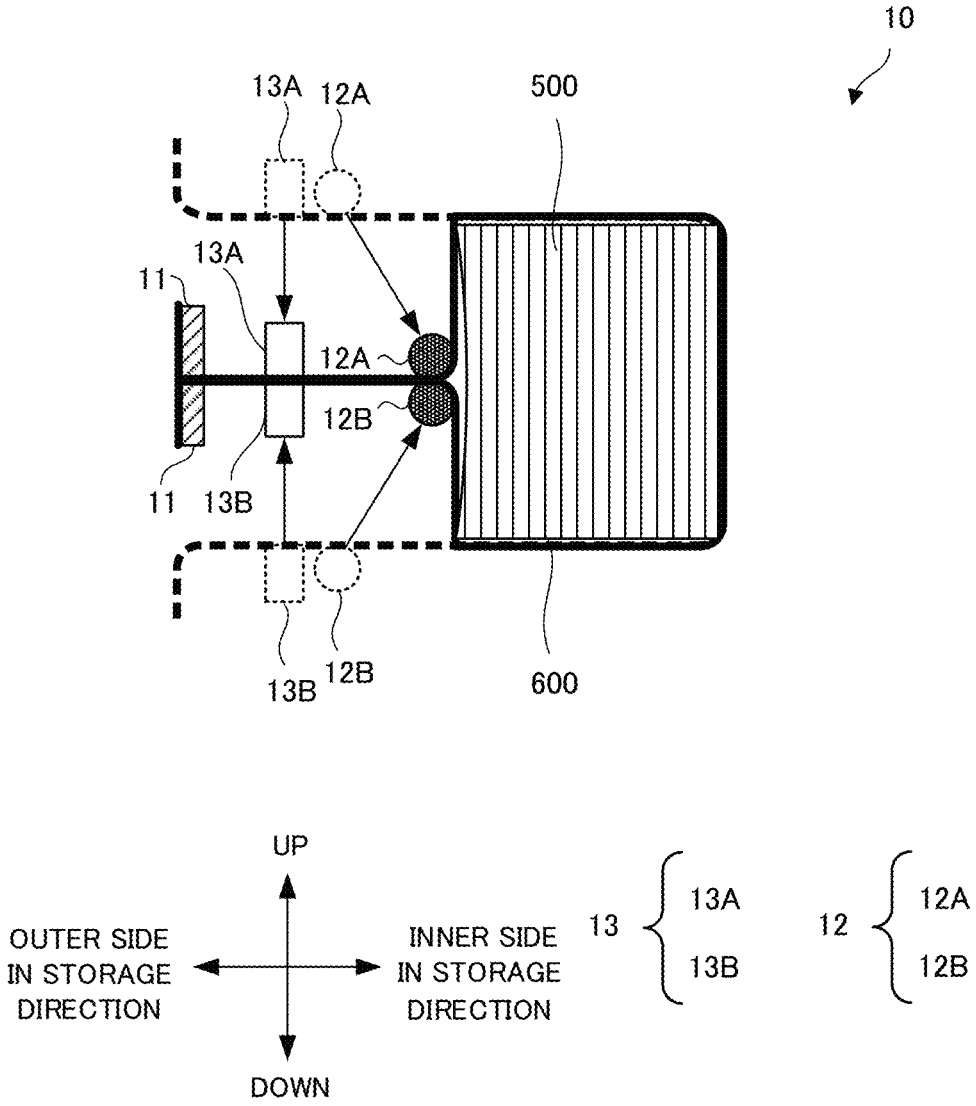
FIG. 7 shows the relationship between a third position and a fourth position of each sealing unit in Embodiment 3.

FIG. 7 is a schematic view showing the relationship between the third position and the fourth position of each sealing unit 13. FIG. 7 shows by broken lines the sealing units 13, the dosing units 12, and the storing bag 600 when each sealing unit 13 is in the third position, and shows by solid lines the sealing units 13, the dosing units 12, and the storing bag 600 when each sealing unit 13 is in the fourth position.

As described in Embodiment 1 and Embodiment 2, when the closing units 12 close the storing bag 600, each closing unit 12 moves toward the second position that is closer to the inner side in the storage direction than the first position. On the other hand, as shown in FIG. 7, the third position and the fourth position, which are positions before and after dosing the storing bag 600, of each sealing unit 13 are positions that are the same in the storage direction. In other words, when the sealing units 13 seal the storing bag 600, the sealing units 13 move straight along an up-down direction orthogonal to the storage direction, and passes through a same position as the third position in the storage direction.

An operation of the sealing units 13 sandwiching the storing bag 600 and an operation of the closing units 12 closing the storing bag 600 are performed in response to each other. That is, when the storing of the sheets 500 in the storing bag 600 is completed, each sealing unit 13 moves from the third position toward the fourth position in response to the movement of each closing unit 12 from the first position toward the second position.

Accordingly, according to the sheet storage apparatus 1 according to the third embodiment, the storing bag 600 is sealed by the sealing units 13 disposed closer to the outer side in the storage direction than the closing units 12. Therefore, the locations where the sealing units 13 seal the storing bag 600 are situated closer to the outer side in the storage direction than the locations where the closing units 12 close the storing hag 600. Therefore, the sheets 500 are less likely to be jammed at the locations where the sealing units 13 seal the storing bag 600. Consequently, when the storing bag 600 is sealed by the sealing units 13, it is possible to prevent a situation in which the sheets 500 can no longer be sealed due to jamming of the sheets 500.

Embodiment 4

Figure 8A:
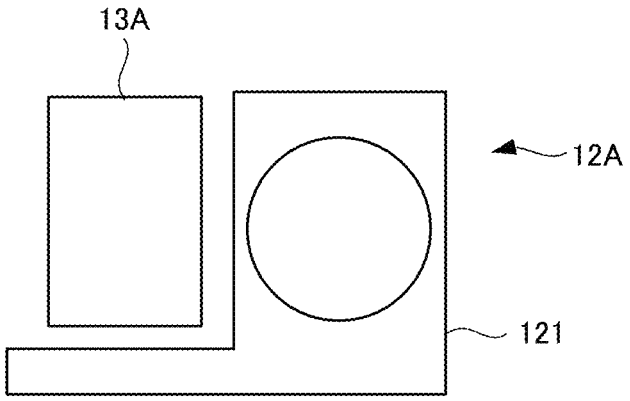
FIG. 8A shows a closing unit at a first position and a sealing unit at a third position in Embodiment 4.

In Embodiment 4, an example in which each closing unit 12 comprises a covering unit 121 that covers a corresponding sealing unit 13 at a third position is described, FIG. 8A is a schematic view showing a closing unit 12 at a first position and a sealing unit 13 at the third position. Although FIG. 8A shows only one closing unit 12 of a pair of closing units 12 and only one sealing unit 13 of a pair of sealing units 13 (a first closing unit 12A and a first sealing unit 13A), a second closing unit 12B similarly comprises a covering unit and covers a second sealing unit 13B corresponding thereto at the third position.

As shown in FIG. 8A, the closing unit 12 comprises the covering unit 121. The covering unit 121 is a member that covers the sealing unit 13 at the third position. When the sealing unit 13 is, for example, a heater, heat generated by the sealing unit 13 may be transmitted to a structure around the sealing unit of the sheet storage apparatus 1. Since the covering unit 121 covers the sealing unit 13, the effect of the heat generated by the sealing unit 13 on the surrounding structure can be reduced.

Figure 8B:
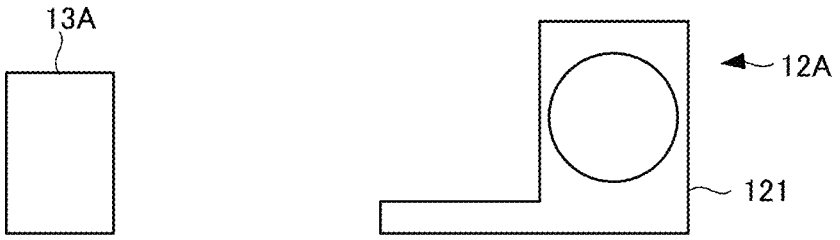
FIG. 8B shows the closing unit at a second position and the sealing unit at a fourth position in Embodiment 4.

FIG. 8B is a schematic view showing the relationship between the position of the closing unit 12 at a second position and the position of the sealing unit 13 at a fourth position. Although FIG. 8B also shows only one closing unit 12 of the pair of closing units 12 and only one sealing unit 13 of the pair of sealing units 13, the other closing unit 12 is also in a state similar to that in FIG. 8B. As shown in FIG. 8B, when the closing unit 12 and the sealing unit 13 move in response to each other, the sealing unit 13 is not covered by the covering unit 121 and is exposed from the covering unit 121.

As shown in FIG. 8B, since the second position is situated closer to an inner side in a storage direction than the first position, the second position is situated closer to the inner side than the fourth position that is a position that is the same as the third position in the storage direction. Therefore, the sealing unit 13 at the fourth position is situated away from the closing unit 12 at the second position, and is not covered by the covering unit 121. Consequently, sheets 500 are less likely to be jammed at a location where the sealing unit 13 seals a storing bag 600, Thus, when the storing bag 600 is sealed by the sealing unit 13, it is possible to prevent a situation in which the sheets 500 can no longer be sealed due to jamming of the sheets 500.

Embodiment 5

In Embodiment 5, a control unit 50 controls the operations of closing units 12 and sealing units 13.

Figure 9:
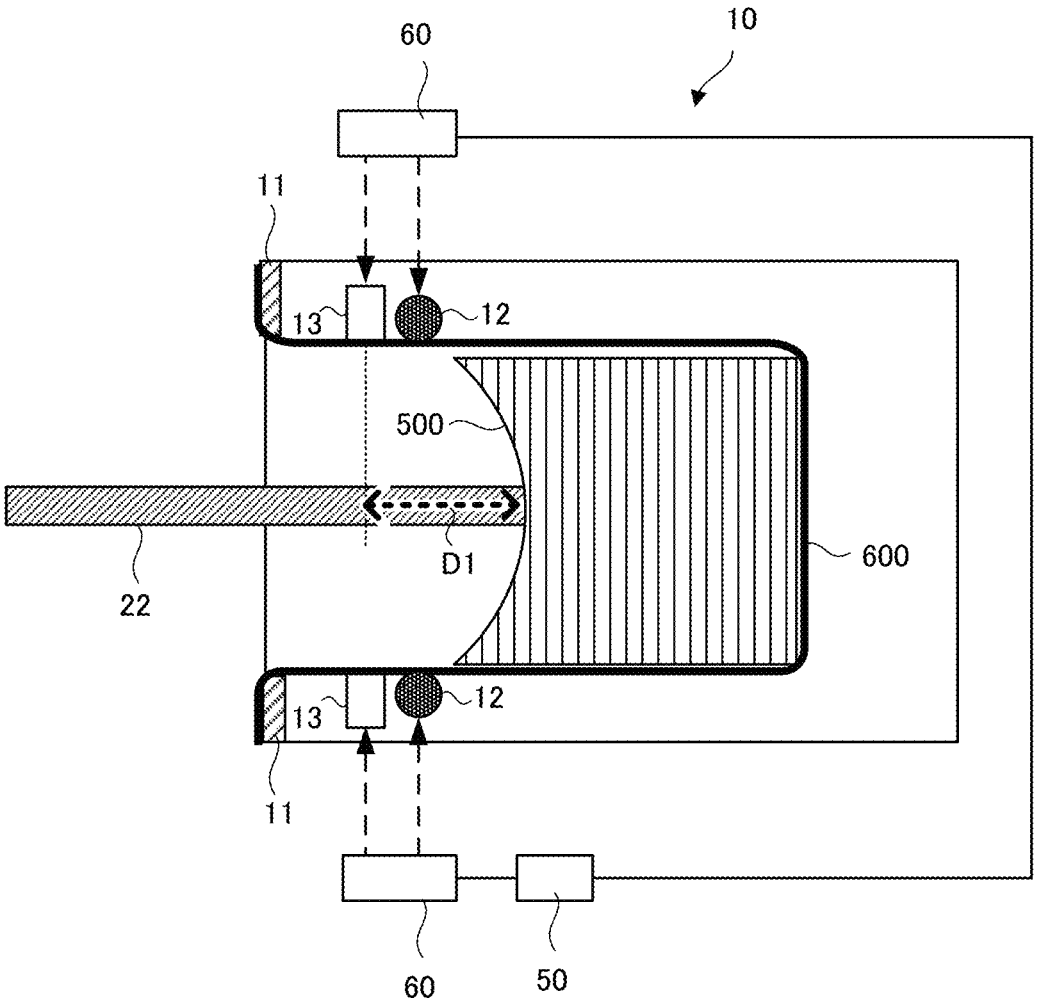
FIG. 9 shows a structure comprised in a sheet storage apparatus according to Embodiment 5.
Figure 9:
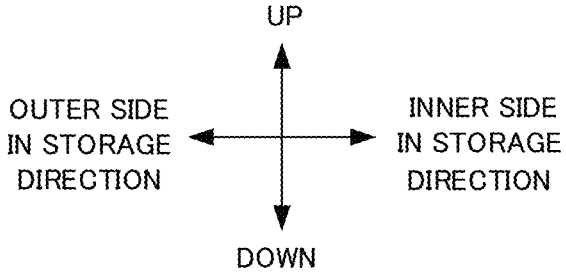

FIG. 9 shows a structure comprised in a sheet storage apparatus according to Embodiment 5. As shown in FIG. 9, a sheet storage apparatus 1 comprises the control unit 50 that is electrically connected to drive units 60 that apply drive force for moving the closing units 12 and the sealing units 13. Each drive unit 60 is, for example, a motor. Dashed arrows in FIG. 9 schematically denote a state in which each drive unit 60 supplies drive force to a corresponding one of the closing units 12 and a corresponding one of the sealing units 13.

On the basis of whether the distance between positions of the sealing units 13 in a storage direction and a position where a holding unit 22 holds down sheets 500 is less than or equal to a threshold distance, the control unit 50 controls whether the sealing units 13 are to start sealing a storing bag 600.

The position where the holding unit 22 holds down the sheets 500 refers to a position in the storage direction where an end portion of the holding unit 22 on an inner side in the storage direction is in contact with the sheets 500 that are stored inside the storing bag 600.

The distance between the positions of the sealing units 13 in the storage direction and the position where the holding unit 22 holds down the sheets 500 is shown by distance D1 in FIG. 9. The control unit 50 calculates the distance D1 on the basis of, for example, the position in the storage direction of the end portion of the holding unit 22 that is detected by a position sensor attached to the end portion of the holding unit 22 on the inner side in the storage direction, and a previously measured position in the storage direction of each sealing unit 13. When the control unit 50 compares a predetermined threshold distance Dth and the distance D1 with each other and D1≤Dth, the control unit 50 controls the closing units 12 and the sealing units 13 to start sealing of the storing bag 600. Note that "to start sealing of the storing bag 600" means that a series of operations of closing the storing bag 600 by the closing units 12 and sealing the storing bag 600 by the sealing units 13 is started.

On the other hand, when D1>Dth, the control unit 50 does not start sealing of the storing bag 600 performed by using the closing units 12 and the sealing units 13.

Accordingly, according to the sheet storage apparatus 1 according to Embodiment 5, the sealing of the storing bag 600 performed by using the closing units 12 and the sealing units 13 is started only when the distance D1 between the positions of the sealing units 13 in the storage direction and the position where the holding unit 22 holds down the sheets 500 is less than or equal to the threshold distance Dth. Therefore, when a sufficient number of sheets 500 is not stored inside the storing bag 600, it is possible not to seal the storing bag 600. Therefore, wasteful use of the capacity of the storing bag 600 caused by the storing bag 600 being sealed when the number of sheets 500 stored in the storing bag 600 is small can be prevented.

Embodiment 6

In Embodiment 6, a method of realizing the movement of the closing units 12 described from Embodiment 1 to Embodiment 5 is described.

Figure 10:
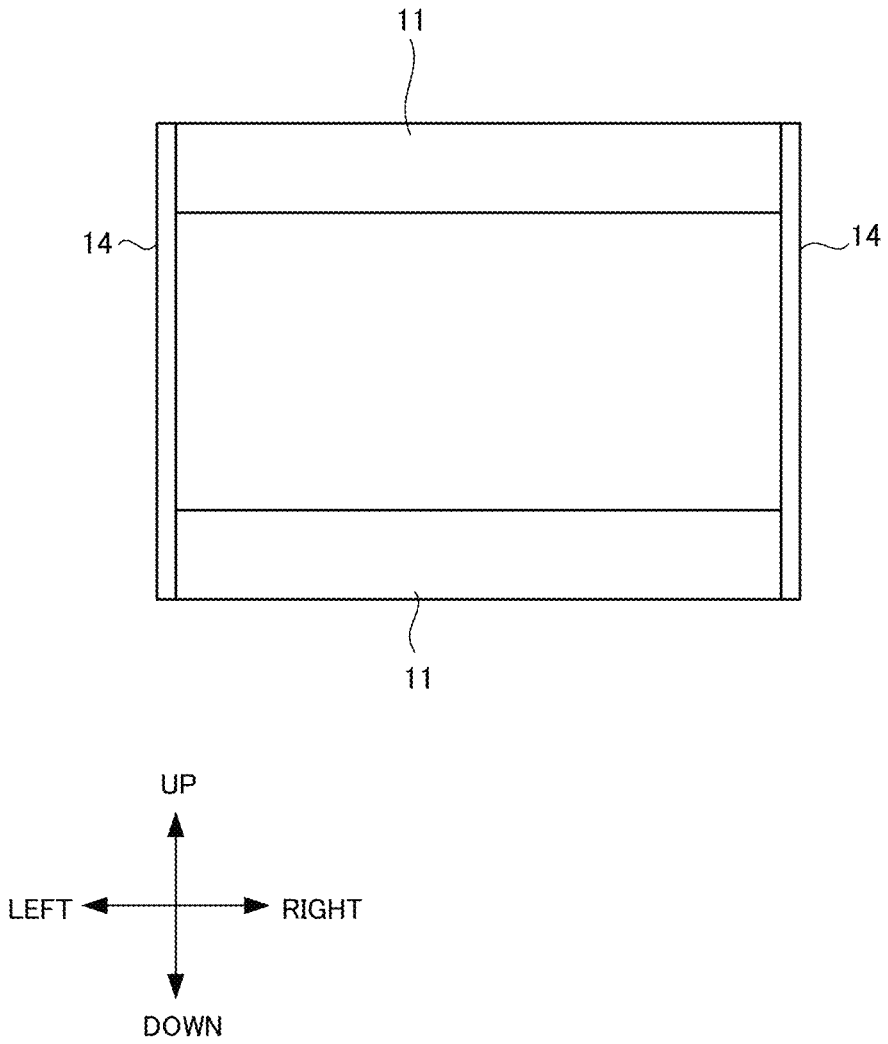
FIG. 10 shows a state of a structure, disposed closer to an inner side in a storage direction than attachment units, of a sheet storage apparatus when seen from an outer side in the storage direction.

FIG. 10 shows a state of a structure, disposed closer to an inner side in a storage direction than attachment units 11, of a sheet storage apparatus 1 when seen from an outer side in the storage direction. That is, in FIG. 10, a near side in a sheet plane corresponds to the outer side in the storage direction, and a far side in the sheet plane corresponds to the inner side in the storage direction. Note that, in the description below, for convenience sake, a direction orthogonal to an up-down direction and the storage direction is referred to as a left-right direction. In addition, in the description below, when seen from the outer side in the storage direction, the right side of the attachment units 11 of the sheet storage apparatus 1 is simply referred to as the right side, and the left side of the attachment units 11 of the sheet storage apparatus 1 is simply referred to as the left side.

As shown in FIG. 10, the attachment units 11 are provided, one on an upper end portion and the other on a lower end portion of the sheet storage apparatus 1. As shown in FIG. 10, the attachment units 11 extend in the left-right direction. Although not shown in FIG. 10, a storing hag 600 attached to the attachment units 11 is disposed so that its entrance faces the near side in the sheet plane, and its body portion extends toward the far side in the sheet plane, that is, the inner side in the storage direction.

Figure 11:
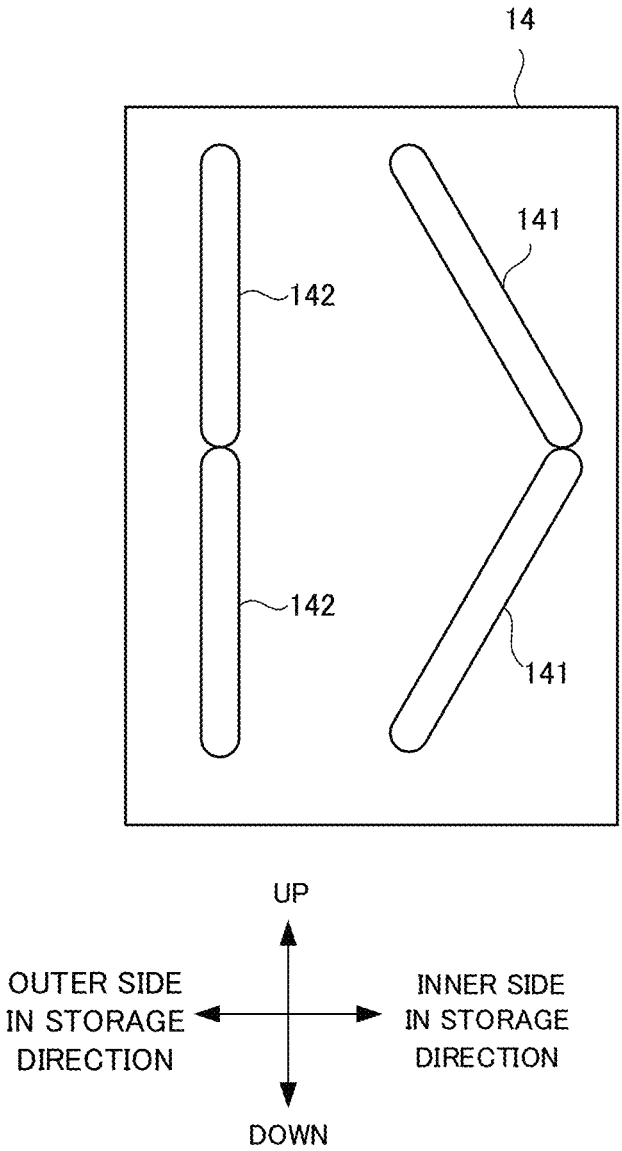
FIG. 11 shows an example of a guide plate when seen from the right side of the sheet storage apparatus.

As shown in FIG. 10, guide plates 14, which are a pair of plate-shaped members, are provided, one on a left end portion and the other on a right end portion of the sheet storage apparatus 1. FIG. 11 shows one guide plate 14 when seen from the right side of the sheet storage apparatus 1. As shown in FIG. 11, the guide plate 14 has guide grooves 141 and guide grooves 142. Each guide groove 141 is a groove that guides the movement of the closing units 12, and each guide groove 142 is a groove that guides the movement of the sealing units 13.

Figure 12:
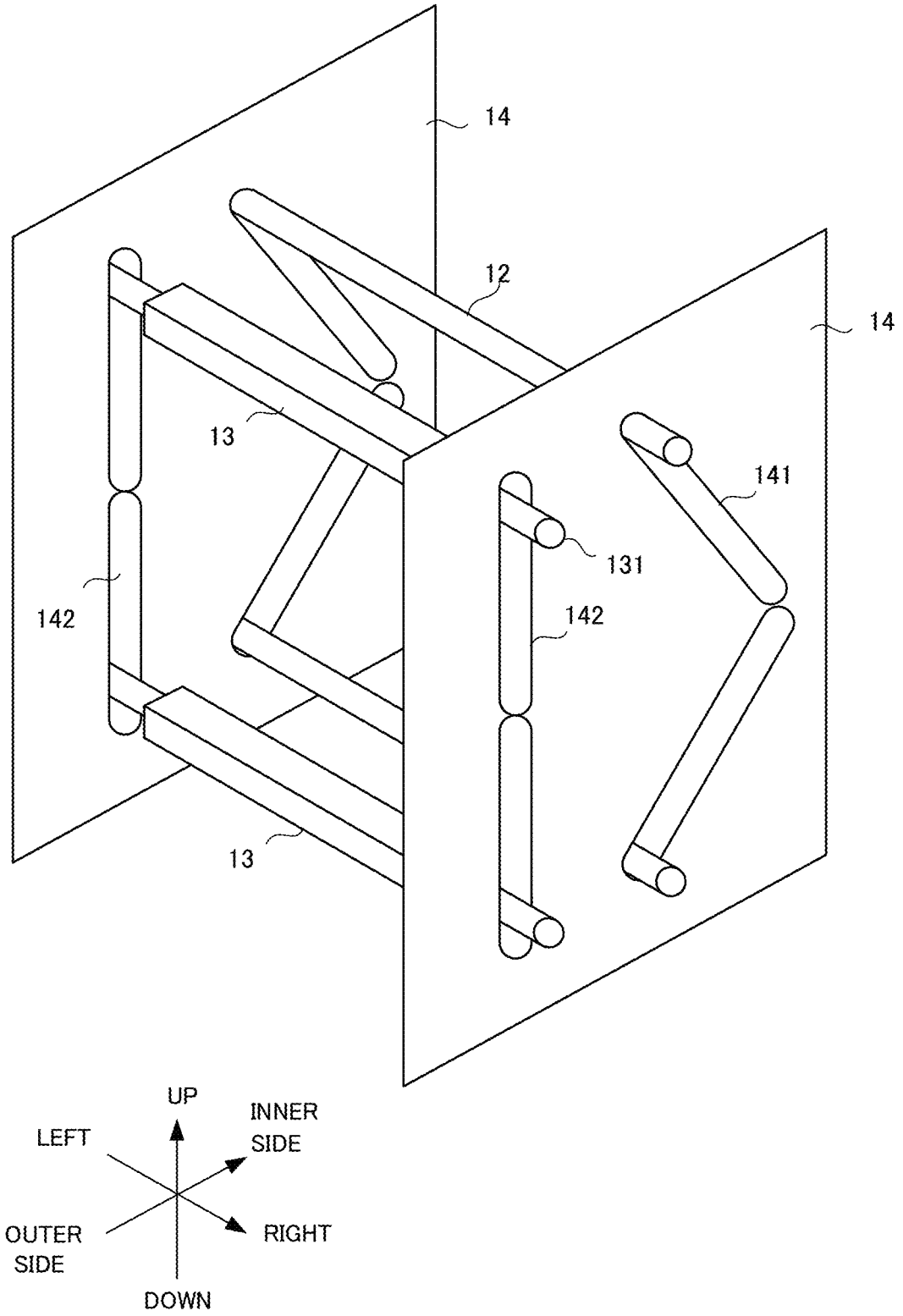
FIG. 12 is a schematic view showing the relationship between the positions of a pair of guide plates and the positions of closing units and the positions of sealing units.

FIG. 12 is a schematic view showing the relationship between the positions of the pair of guide plates 14 and the positions of the closing units 12 and the positions of the sealing units 13, FIG. 12 shows only the pair of guide plates 14, the closing units 12, and the sealing units 13 in perspective.

As shown in FIG. 12, two end portions of each closing unit 12 formed with a rod shape are each inserted into a corresponding one of the two guide grooves 141 of a corresponding one of the two guide plates 14. Therefore, the closing units 12 sandwich the storing bag 600 by moving in accordance with the shapes of the guide grooves 141. In the example show r in FIGS. 11 and 12, each guide groove 141 is formed with an oblique and linear shape with respect to the up-down direction and the storage direction. In this case, a path of movement of each closing unit 12 is, as with the paths of movements shown in FIG. 3, a path of movement toward the inner side in the storage direction with decreasing distance to an intermediate position in the up-down direction.

As shown in FIG. 12, two end portions of a shaft portion 131 of each sealing unit 13 are each inserted into a corresponding one of the two guide grooves 142 of a corresponding one of the two guide plates 14. Therefore, the sealing units 13 move in accordance with the shapes of the guide grooves 142. In the example shown in FIG. 11 and FIG. 12, each guide groove 142 is formed with a linear shape along the up-down direction. In this case, a path of movement of each sealing unit 13 is, as with the paths of movements shown in FIG. 7, a path of movement for linear movement in the up-down direction.

Figure 13:
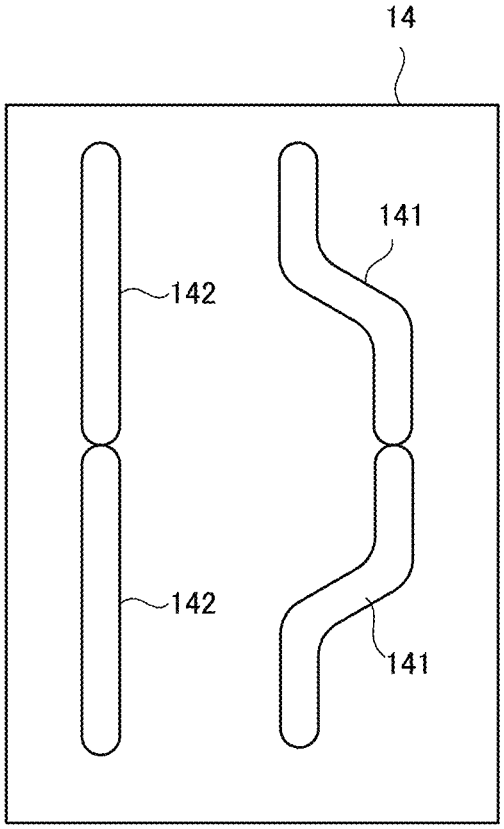
FIG. 13 shows another example of a guide plate when seen from the right side of the sheet storage apparatus.
Figure 13:
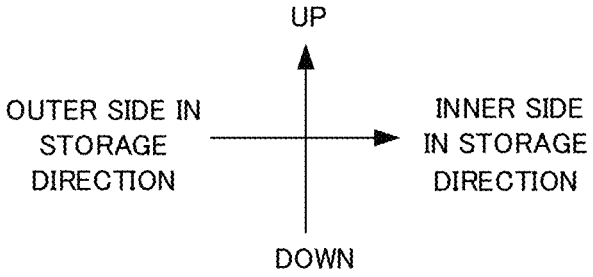

Note that the shapes of the guide grooves 141 and the guide grooves 142 shown in FIG. 11 and FIG. 12 are examples, and the present disclosure is not limited thereto. For example, FIG. 13 shows an example of a guide plate having crank-shaped guide grooves 141. When the guide grooves 141 have such a shape, a path of movement of each closing unit 12 is a crank-shaped path of movement as shown in FIG. 5.

Accordingly, the movements of the closing units 12 and the sealing units 13 described in each of the embodiments above can be realized by a simple structure in which two guide plates 14 are provided al the two end portions of an attachment unit 10.

Embodiment 7

In Embodiment 7, an example in which each closing unit 12 comprises a contact portion 123 for contacting a storing bag 600 is described. Note that, in Embodiment 7, the closing units 12 are assumed to move along the crank-shaped guide grooves 141 shown in FIG. 12 and to take crank-shaped paths of movements.

Figure 14:
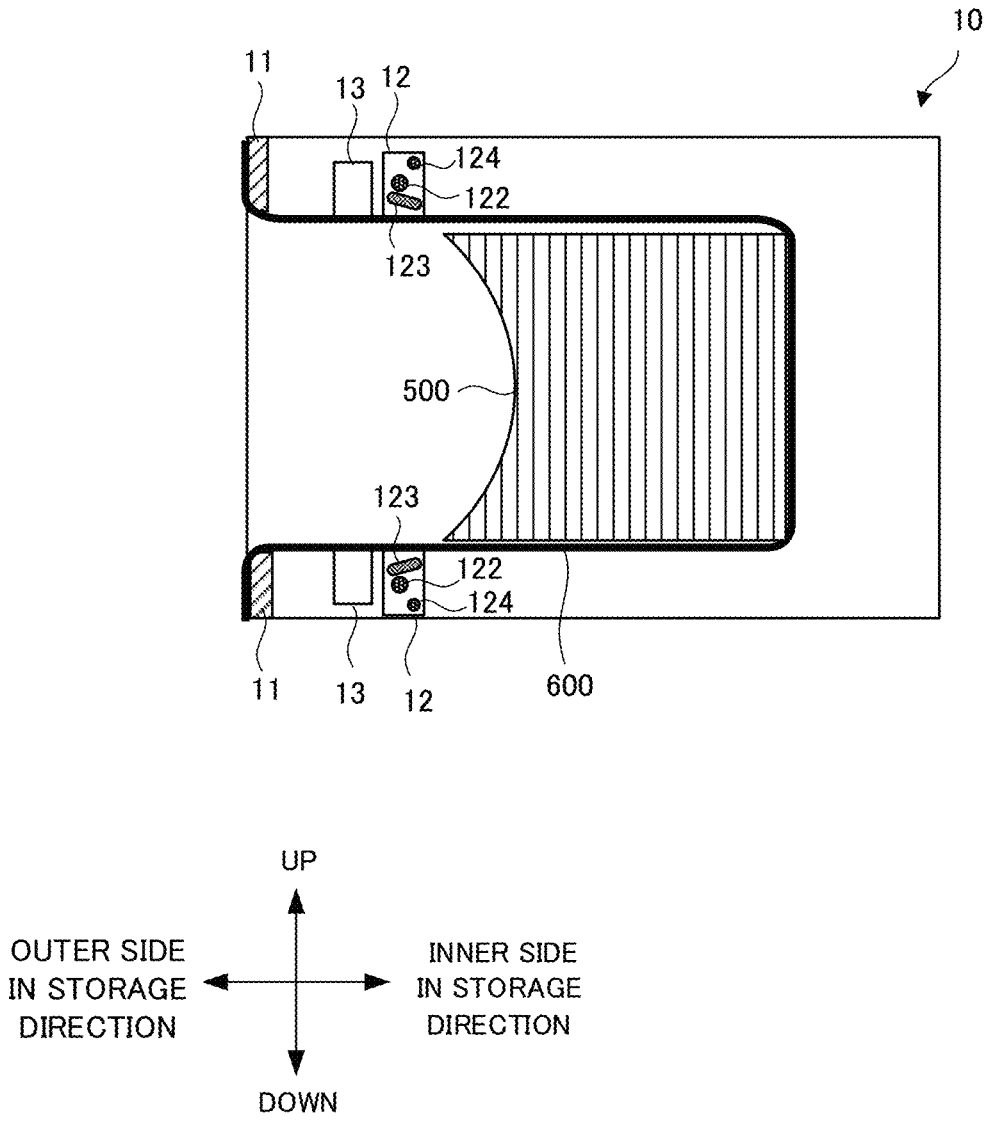
FIG. 14 shows each closing unit comprising a contact portion in Embodiment 7.

FIG. 14 shows each closing unit 12 comprising the contact portion 123. FIG. 14 is a sectional view of a sheet storage apparatus 1 in a plane orthogonal to an up-down direction and a storage direction of the sheet storage apparatus 1.

Figure 15:
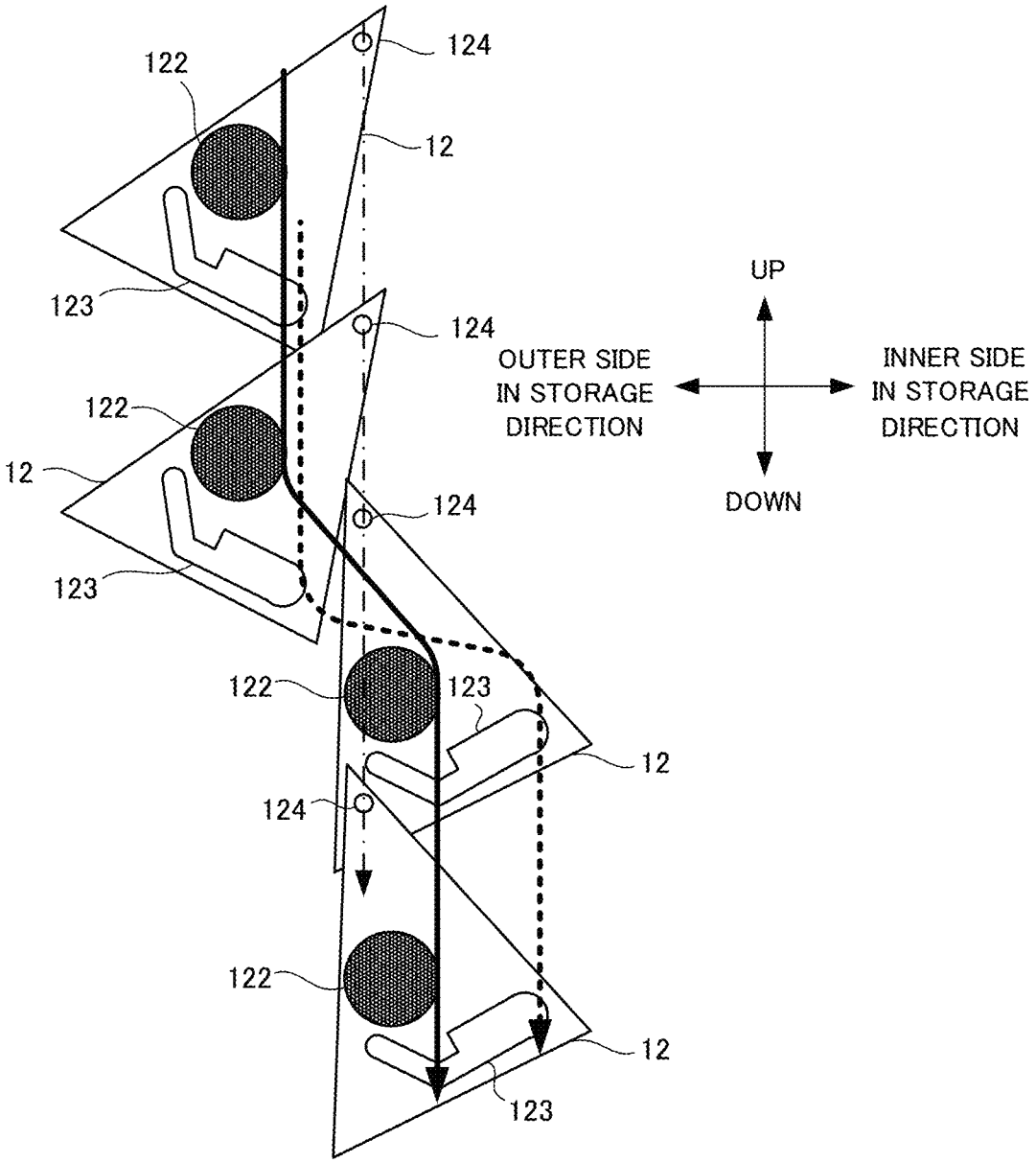
FIG. 15 shows, in Embodiment 7, a path of movement of a body portion and a path of movement of a rotating shaft when a closing unit moves from a first position to a second position, and movement of the corresponding contact portion resulting therefrom.

As shown in FIG. 14, each closing unit 12 further comprises a body portion 122, the contact portion 123, and a rotating shaft 124. Each body portion 122 is a rod-shaped member, and, when each closing unit 12 sandwiches the storing bag 600, each body portion 122 moves along the corresponding guide grooves 141 of the guide plates 14 shown in FIG. 12. Each contact portion 123 is fixed to the corresponding body portion 122, and is configured to be rotatable around the corresponding rotating shaft 124. Each rotating shaft 124 is a shaft provided at a position farther away from the storing bag 600, attached to attachment units 11, than its corresponding body portion 122. When each closing unit 12 sandwiches the storing bag 600, each rotating shaft 124 moves along the up-down direction so as not to change its position in the storage direction, FIG. 15 shows a path of movement of a body portion 122 and a path of movement of an end portion of a contact portion 123 when a first closing unit 12A moves from a first position toward a second position. In FIG. 15, a solid arrow indicates the path of movement of the body portion 122, a dashed arrow indicates the path of movement of an end portion of the contact portion 123, and an alternate-long-and-short-dash-line arrow indicates a path of movement of a rotating shaft 124. Note that although the closing unit 12 is shown as having a triangular shape in FIG. 15, such a shape is one example, and thus the dosing unit 12 may have any other shape.

As described above, each rotating shaft 124 moves along the up-down direction so that its position in the storage direction does not change. This means that drive units that supply drive force to the closing units 12 are to supply only drive force in the up-down direction to the closing units 12 regardless of the shape of a movement locus of each dosing unit 12.

When each closing unit 12 sandwiches the storing bag 600, the body portion 122 moves along the crank-shaped guide grooves 141, as a result of which, as the position of the body portion 122 in the up-down direction becomes closer to an intermediate position, the position of the body portion 122 in the storage direction moves from an outer side toward an inner side as shown in FIG. 15.

As described above, since each contact portion 123 is fixed to its corresponding body portion 122, as the relationship between each body portion 122 and its corresponding rotating shaft 124 changes, the position of each contact portion 123 also changes as shown in FIG. 15.

As shown in FIG. 14, each contact portion 123 is disposed closer to the storing hag 600 attached to the attachment units 11 than its corresponding body portion 122. Therefore, as described above, when the closing units 12 sandwich the storing bag 600, the contact portions 123 come into contact with the storing bag 600 before the body portions 122 come into contact with the storing bag 600. Note that, since an end portion of each contact portion 123 that comes into contact with the storing bag 600 is formed with a shape without a corner, the storing bag 600 can be prevented from being damaged when the end portion of each contact portion 123 have contacted the storing hag 600.

As shown in FIG. 15, at an initial stage in which the closing unit 12 starts sandwiching the storing bag 600, the end portion of the protruding contact portion 123 faces relatively downward. On the other hand, in a latter stage in which the sandwiching of the storing bag 600 by the closing unit 12 has progressed, the end portion of the protruding contact portion 123 faces relatively upward.

In the initial stage in which the closing unit 12 starts sandwiching the storing bag 600, since the storing bag 600 is in an unclosed state, the storing bag 600 can be efficiently closed due to the downwardly facing contact portion 123 contacting the storing bag 600. In the latter stage in which the sandwiching of the storing bag 600 by the closing unit 12 has progressed, the contact portion 123 that has faced upward contacts the vicinity of an entrance of the closed storing bag 600 from therebelow. Therefore, the end portion of the contact portion 123 pushes the sheets 500 existing inside the storing bag 600. Consequently, the sheets 500 inside the storing bag 600 can be effectively prevented from being jammed when closing the storing bag 600.

Due to such a structure, by using a simple structure in which the drive units that move the closing units 12 supply drive force in the up-down direction to the closing units 12, the paths of movements of the body portions 1 can become complicated paths that avoid the sheets 500 whose end portions have been bent.

Since the contact portion 123 that rotates around the rotating shaft 124 is provided, as shown in FIG. 15, the path of movement, which is bent at a steep angle on the inner side in the storage direction at a midway point in the up-down direction, of the contact portion 123 can be realized by a simple structure in which drive force in the up-down direction is supplied to the closing units 12.

Embodiment 8

In Embodiment 8, a sheet processing apparatus 100 comprising the sheet storage apparatus 1 according to any one of the embodiments described above is described.

The sheet processing apparatus 100 is an apparatus comprising a processing unit that performs various processing operations, such as a depositing operation or withdrawing operation of sheets, by controlling each mechanism inside the apparatus. In the description below, the side where a receiving unit 103 (described below) of the sheet processing apparatus 100 is disposed is defined as the front and the opposite side is defined as the rear. A horizontal direction orthogonal to a front-rear direction is defined as a left-right direction.

Figure 16:
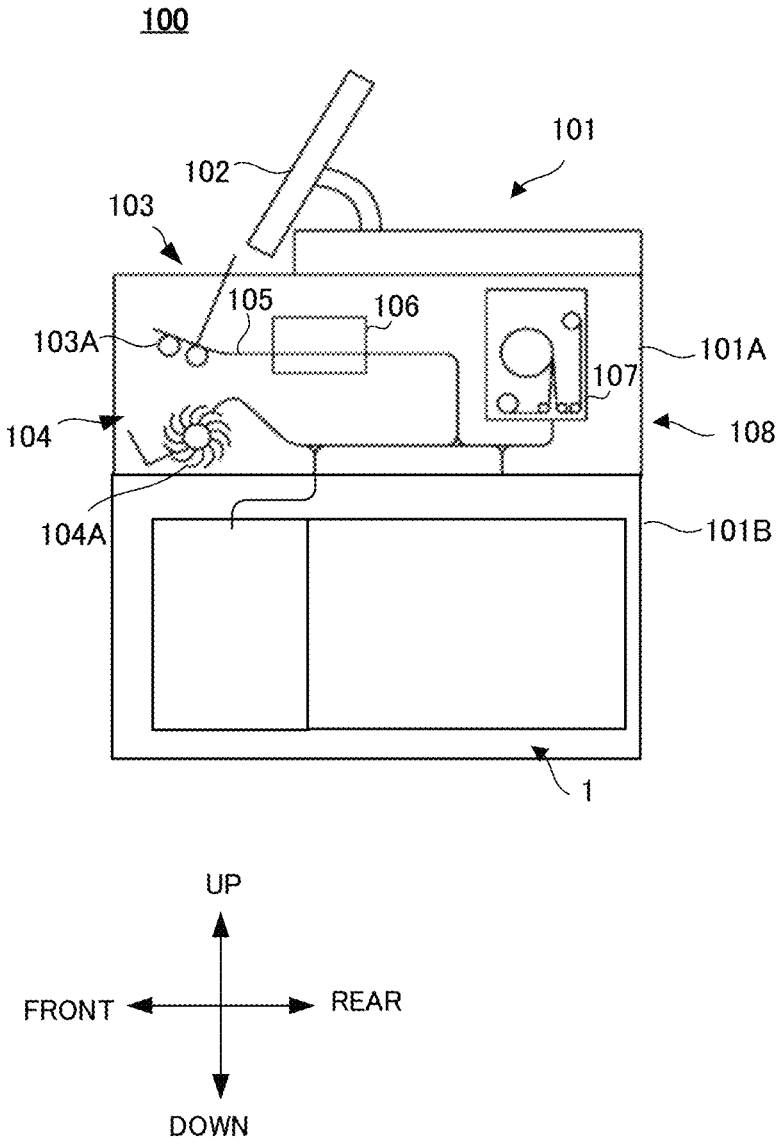
FIG. 16 shows a structure of a sheet processing apparatus in Embodiment 8.

As shown in FIG. 16, the sheet processing apparatus 100 comprises a housing 101 having a substantially parallelepiped shape. An upper unit 101A and a lower unit 101B are stored inside the housing 101.

A processing unit 108 comprising an operation unit 102, the receiving unit 103, an outlet unit 104, a transport unit 105, a recognition unit 106, and a storing feeding unit 107 is provided at the upper unit 101A.

The operation unit 102 is provided at an upper portion of the housing 101. The operation unit 102 accepts an operation by a user of the sheet processing apparatus 100. The sheet processing apparatus 100 performs various processing operations in accordance with the operation of the user with respect to the operation unit 102. The operation unit 102 may be, for example, a touch panel superimposed upon a display, such as a liquid crystal display. In this case, the display is provided with, for example, a screen allowing the user to select a processing operation to be performed by the sheet processing apparatus 100 or a screen showing the quantity of sheets 500 (for example, the number of sheets or the amount of money) stored inside the sheet processing apparatus 100.

The receiving unit 103 is provided at an upper portion of a front surface of the housing 101. The receiving unit 103 comprises, for example, a receiving hopper for depositing a banknote into the housing 101 from the outside thereof. The outlet unit 104 for ejecting thereon a banknote inside the housing 101 to the outside thereof is provided below the receiving unit 103.

The receiving unit 103 receives a sheet group including one or more sheets, which is set by a user. The receiving unit 103 comprises a feeding mechanism 103A for feeding the sheets of the sheet group one sheet at a time into the housing 101. The sheets that have been fed one sheet at a time from the feeding mechanism 103A is transported one sheet at a time by the transport unit 105.

The recognition unit 106 is provided in a transport path of the transport unit 105. The recognition unit 106 recognizes, for example, the denomination, the authenticity, the face/back, the fitness, the newness/oldness, or the transport state of the sheets that are transported by the transport unit 105.

The storing feeding unit 107 (temporary storing unit) is provided at a downstream side of the recognition unit 106 at the transport unit 105. The storing feeding unit 107 temporarily stores the sheets that have been transported from the transport unit 105, and feeds the stored sheets one sheet at a time to the transport unit 105. Therefore, banknotes stored in the storing feeding unit 107 can be transported to the sheet storage apparatus 1, provided at the lower unit 101B, from the storing feeding unit 107. Note that the storing feeding unit 107 is constituted by, for example, a tape-reel feeding apparatus.

The outlet unit 104 is connected to the transport unit 105. When, for example, a withdrawing operation of the sheet processing apparatus 100 is to be performed, a required number of sheets is temporarily stacked at the outlet unit 104 by the transport unit 105. The outlet unit 104 is accessible from outside the housing 101, and a user can take out from the front side of the housing 101 sheets stacked at the outlet unit 104.

A stacking wheel 104A is provided at a connection portion of the transport unit 105 that is connected to the outlet unit 104. Due to rotation of the stacking wheel 104A, sheets interposed between vanes of the stacking wheel 104A are stacked at the outlet unit 104.

The processing unit 108 comprising each structure described above performs various processing operations, such as a depositing operation or a withdrawing operation, on sheets received from the receiving unit 103. The depositing operation is an operation of storing the received sheets in the storing feeding unit 107 or the sheet storage apparatus 1, and the withdrawing operation is an operation of withdrawing the sheets from the storing feeding unit 107 to the outlet unit 104.

Figure 17:
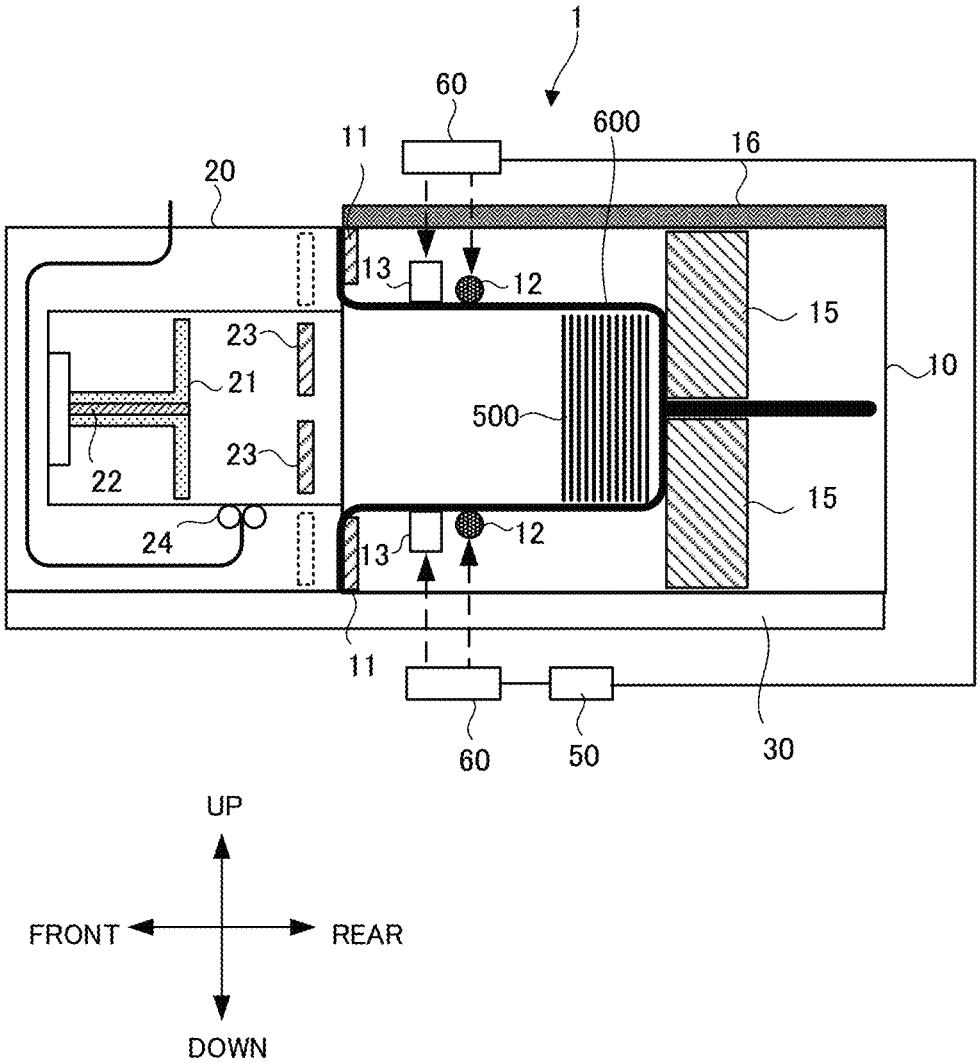
FIG. 17 shows a structure of a sheet storage apparatus in Embodiment 8.

The sheet storage apparatus 1 is provided at the lower unit 101B. FIG. 17 shows the structure of the entire sheet storage apparatus 1. In the sheet storage apparatus 1, a storing bag 600, such as a pouch bag, is attached sideways, and sheets in a standing state are stacked and stored in the storing hag 600. The "sheets in a standing state" refers to a state in which a front surface and a back surface of the sheets face a direction perpendicular to an up-down direction.

As shown in FIG. 17, the sheet storage apparatus 1 comprises an attachment unit 10, a movement unit 20, a slide unit 30, and a control unit 50, In the example shown in FIG. 17, although an entrance of the storing bag 600 is attached so as to face the front side of the sheet processing apparatus 100, the present disclosure is not limited thereto, and, for example, the entrance of the storing bag 600 may face the left side, the right side, or the rear side of the sheet processing apparatus 100, or may face a direction perpendicular to the up-down direction, That is, the right side in FIG. 17 is the front side of the sheet storage apparatus 1, and the left side in FIG. 17 is the rear side of the sheet storage apparatus 1, In FIG. 17, a direction toward the rear side from the front side of the sheet storage apparatus 1 is a direction that is the same as the storage direction in each embodiment above.

The attachment unit 10 is a unit to which the storing bag 600 is attached. The movement unit 20 is a unit that moves sheets 500, transported by the transport unit 105, in a standing state along the storage direction, to store the sheets 500 inside the storing bag 600.

As described in each embodiment above, the attachment unit 10 comprises attachment units 11, closing units 12, sealing units 13, and guide plates 14. Further, the attachment unit 10 comprises a stage 15 and a cover unit 16 as shown in FIG. 17.

The stage 15 that is movable along the storage direction is provided inside the attachment unit 10. The stage 15 is a member that adjusts the depth from the entrance of the storing bag 600 attached sideways to a bottom portion of the storing bag 600. For example, on the basis of control of the control unit 50, the stage 15 is moved by drive force that is supplied by a drive unit (not shown).

A gap is provided near the center of the stage 15 in the left-right direction or the up-down direction. Part of the storing bag 600 can be stretched through the gap toward an inner side in the storage direction. Therefore, the number of sheets 500 that can be stored inside the storing bag 600 can be adjusted by moving the stage 15. FIG. 17 shows an example in which the gap of the stage 15 is provided near the center in the up-down direction.

An opening is provided in an upper surface of the attachment unit 10. The cover unit 16 that can be opened and closed is provided at the opening. The cover unit 16 can be opened and closed by using, for example, a hinge, and a user of the sheet processing apparatus 100 opens and closes the cover unit 16 with his hand. When the sheet storage apparatus 1 is stored in the sheet processing apparatus 100, the cover unit 16 is in a closed state. As described later, although the attachment unit 10 can be drawn out to the outside of the housing 101 by the slide unit 30, when the attachment unit 10 has been drawn out of the housing 101, the user can easily access the inside of the sheet storage apparatus 1, in particular, the attachment units 11 by opening the cover unit 16. Therefore, the user can easily attach the storing bag 600 to the attachment unit 10.

As shown in FIG. 17, the movement unit 20 comprises a pushing unit 21, a holding unit 22, a restricting unit 23, and a feeding unit 24. The movement unit 20 is disposed adjacent to the attachment unit 10 on the outer side of the attachment unit 10 in the storage direction, that is, on the side where the attachment units 11 are disposed. The pushing unit 21, the holding unit 22, and the restricting unit 23 each move by drive force that is supplied by a drive unit (not shown) on the basis of control of the control unit 50. For example, one drive unit may supply drive force to the pushing unit 21, the holding unit 22, and the restricting unit 23, or different drive units may each supply drive force to a corresponding one of the pushing unit 21, the holding unit 22, and the restricting unit 23.

The pushing unit 21 moves sheets 500 that are supplied from the outside of the movement unit 20 by pushing them into the storing bag 600, attached to the attachment unit 10, from the inside of the movement unit 20.

The pushing unit 21 is capable of moving along the storage direction from the outer side to the inner side in the storage direction or from the inner side to the outer side in the storage direction. When the pushing unit 21 moves from the outer side toward the inner side in the storage direction, the sheets 500 are pushed by an end portion, near the attachment unit 10, of the pushing unit 21 and are pushed into the storing bag 600. At this time, the sheets 500 in a standing state are pushed by the pushing unit 21. Note that, in the description below, the end portion, near the attachment unit 10, of the pushing unit 21 is simply referred to as the "end portion of the pushing unit 21".

Therefore, the sheets 500 are in a standing state stacked and stored inside the storing bag 600. When the sheets 500 are pushed up to an inner portion of the storing bag 600, the pushing unit 21 is returned to its initial position inside the movement unit 20. The initial position of the pushing unit 21 refers to, for example, a position situated on an outermost side in the storage direction, that is, a position where the pushing unit 21 is farthest from the attachment unit 10 in a movable region of the pushing unit 21.

The end portion of the pushing unit 21 is formed with a shape that allows the sheets 500 in a standing stale to be efficiently pushed. The details of the shape of the end portion of the pushing unit 21 are described later. A gap where the holding unit 22 is disposed is provided near the center of the pushing unit 21 in the up-down direction.

The holding unit 22 is a plate-shaped or a rod-shaped member that holds the sheets 500 that have been pushed into the storing bag 600 by the pushing unit 21. The holding unit 22 is disposed inside the gap provided near the center of the pushing unit 21 in the up-down direction. The holding unit 22 can move along the storage direction via the gap. The pushing unit 21 and the holding unit 22 are not fixed to each other and move independently with respect to each other.

The restricting unit 23 is a member that is provided near a boundary between the movement unit 20 and the attachment unit 10, and that restricts the movement of the sheets 500 inside the movement unit 20 into the storing hag 600. The restricting unit 23 supports banknotes stored in the storing bag 600 between it and the stage. When the sheets 500 are not moved into the storing bag 600 by the pushing unit 21, the restricting unit 23 restricts the movement of the sheets 500 to prevent unintended movement of the sheets 500 into the storing bag 600. When the sheets 500 are moved into the storing bag 600 by the pushing unit 21, the restricting unit 23 stops the restriction.

As shown in FIG. 17, the restricting unit 23 has a structure that is split into an upper portion and a lower portion. The upper portion of the restricting unit 23 is configured to be movable upward, and the lower portion of the restricting unit 23 is configured to be movable downward. Therefore, the restricting unit 23 can be opened and closed. In FIG. 17, the position of the dosed restricting unit 23 is shown by a solid line and the position of the open restricting unit 23 is shown by a dashed line.

Figure 18:
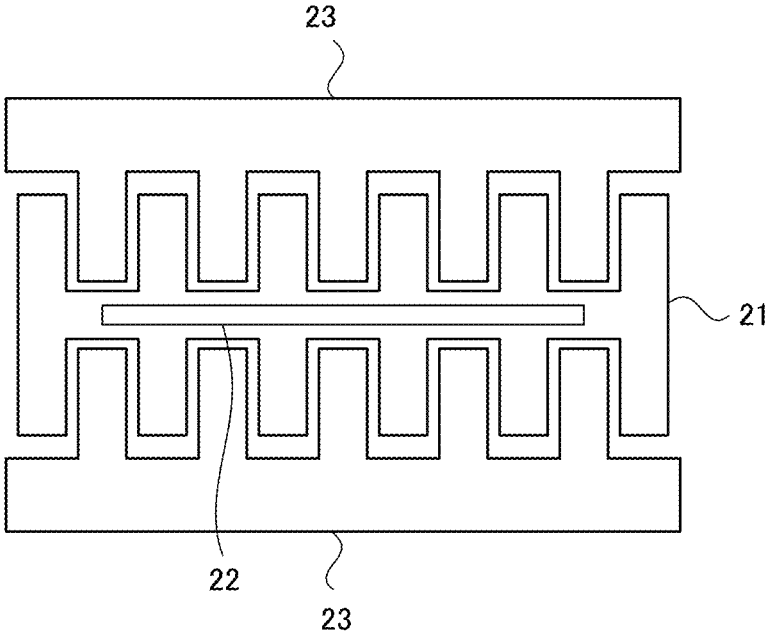
FIG. 18 shows a pushing unit, a holding unit, and a restricting unit when seen from an inner side in a storage direction in Embodiment 8.

FIG. 18 shows the pushing unit 21, the holding unit 22, and the restricting unit 23 as seen from the inner side in the storage direction.

As shown in FIG. 18, the restricting unit 23 is split into an upper portion and a lower portion, each having the form of comb teeth. FIG. 18 shows the restricting unit 23 in a closed state. Due to such a structure, the restricting unit 23 in the closed state can restrict the movement of the sheets 500 toward the inner side in the storage direction. The restricting unit 23 in the open state can be made not to restrict the movement of the sheets 500 toward the inner side in the storage direction.

As shown in FIG. 18, the end portion of the pushing unit 21 on the inner side in the storage direction is formed with a shape that is capable of passing through gaps between the comb teeth of the closed restricting unit 23. In this way, the end portion of the pushing unit 21 is formed with a shape having a large area in a plane perpendicular to the up-down direction and the storage direction. Therefore, the pushing unit 21 is capable of efficiently pushing the sheets 500 in a standing state.

The feeding unit 24 is a member that feeds the sheets 500 transported by the transport unit 105 into the movement unit 20. The feeding unit 24 performs a feeding operation on the basis of control of the control unit 50. The feeding unit 24 comprises, for example, vanes that rotate, and feeds the sheets 500 into the movement unit 20 by applying momentum toward the inner side in the storage direction to the sheets 500. Therefore, the sheets 500 that have been fed by the feeding unit 24 are stacked in a standing manner on the outer side in the storage direction of the closed restricting unit 23.

The slide unit 30 is a member that causes the attachment unit 10 to slide up to the outside of the housing 101 of the sheet processing apparatus 100. Front, back, left, and right wall surfaces of the lower unit 101B are provided with doors that can be opened and closed, and a user can draw out the attachment unit 10 to the outside of the housing 101 from the open doors by using the slide unit 30. Therefore, the user can easily attach or remove the storing hag 600 to or from the attachment unit 10. The slide unit 30 is, for example, a slide reel member. In the example shown in FIG. 16, the slide unit 30 is provided along the front-rear direction, and the attachment unit 10 can be drawn out of the front door or the back door of the housing 101. Note that the slide unit 30, together with the attachment unit 10, may be configured to slide the movement unit 20. In this case, a slide unit that slides the attachment unit 10 and a slide unit that moves the movement unit 20 may be separately provided.

Using FIGS. 19 to 24, examples of operations of the sheet storage apparatus 1 are described. FIGS. 19 to 24 show, according to steps, the operations of the sheet storage apparatus 1 when a predetermined number of sheets is stored in the storing bag 600. In FIGS. 19 to 24, the closing units 12 and the sealing units 13 that do not appear in the description are not shown.

Figure 19:
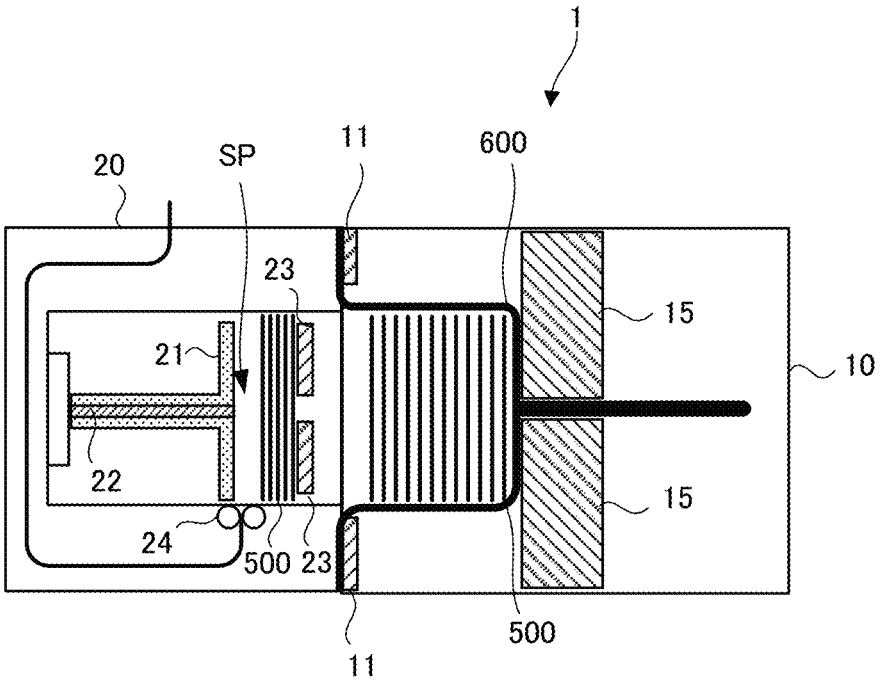
FIG. 19 shows an example of an operation of the sheet storage apparatus when storing sheets in Embodiment 8.

First, as shown in FIG. 19, the feeding unit 24 feeds a predetermined number of sheets 500 to a temporary storing unit SP, which is an internal space of the movement unit 20, and the sheets 500 are stored while leaning on the restricting unit 23 (Step S1). In the example shown in FIG. 19, a certain number of sheets 500 is previously stored inside the storing bag 600, and the stage 15 of the attachment unit 10 moves to a position that is in accordance with the number of sheets 500 that is stored.

Figure 20:
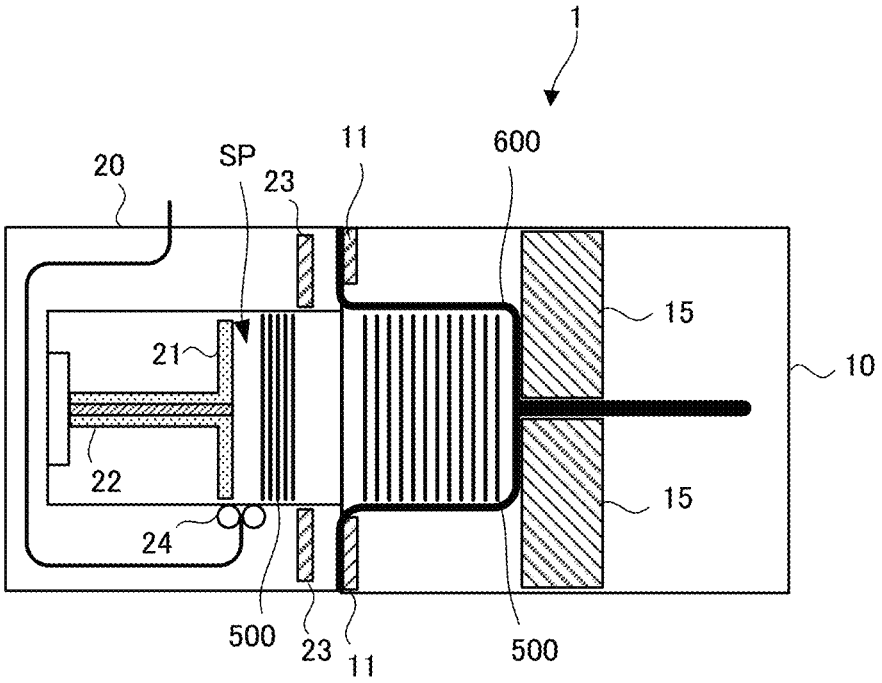
FIG. 20 shows an example of an operation of the sheet storage apparatus when storing the sheets in Embodiment 8.

As shower in FIG. 20, when the predetermined number of sheets 500 is stored, the restricting unit 23 opens (Step S2).

Figure 21:
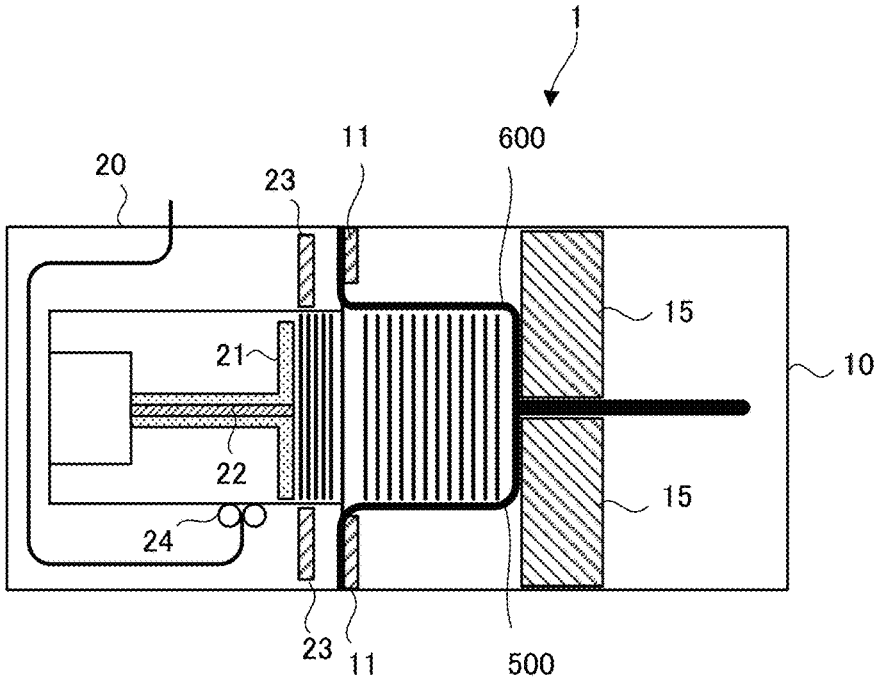
FIG. 21 shows an example of an operation of the sheet storage apparatus when storing the sheets in Embodiment 8.

As shown in FIG. 21, when the restricting unit 23 opens, the pushing unit 21 pushes the sheets 500 toward the inner side in the storage direction up to the inner portion of the storing bag 600 (Step S3). Note that, when the restricting unit 23 opens, the sheets 500 that are stored so as to lean on the restricting unit 23 are temporarily held so as not to fall by the sheets 500 that are previously stored inside the storing bag 600, For example, when sheets 500 do not exist inside the storing bag 600, such as when sheets 500 are to be stored for the first time in a new storing bag 600 attached to the attachment unit 10, due to the stage 15 moving to an outermost side in the storage direction, the sheets 500 can be prevented from falling even if the restricting unit 23 is opened.

Figure 22:
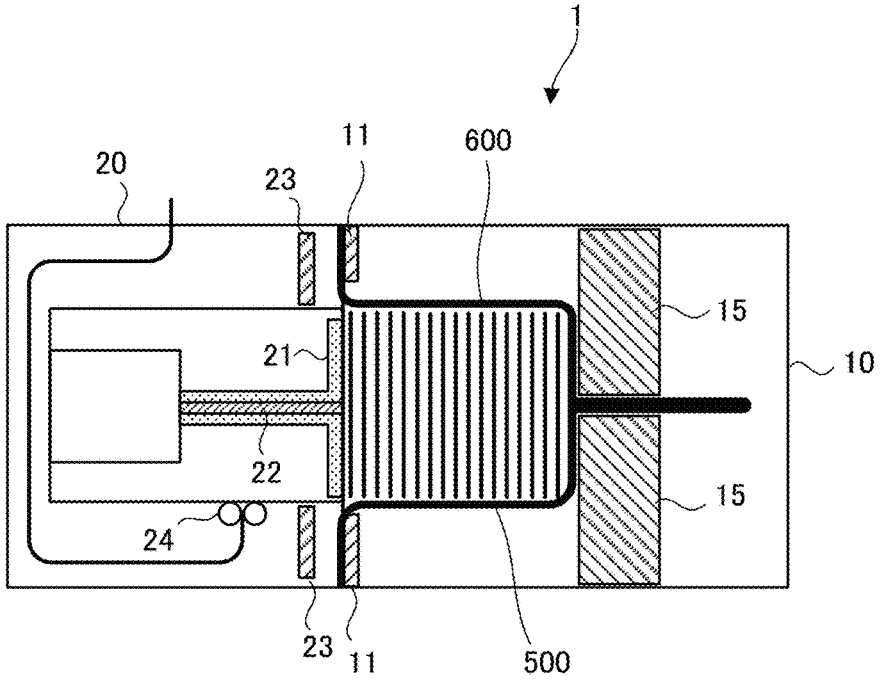
FIG. 22 shows an example of an operation of the sheet storage apparatus when storing the sheets in Embodiment 8.

The movement of the pushing unit 21 toward the inner side in the storage direction continues until the end portion of the pushing unit 21 reaches a predetermined storing position. FIG. 22 shows a state in which the end portion of the pushing unit 21 has reached the storing position. Note that, when the end portion of the pushing unit 21 cannot reach the storing position due to the thickness of the sheets 500 stored inside the storing bag 600, as shown in FIG. 22, the stage 15 moves toward the inner side in the storage direction to cause the end portion of the pushing unit 21 to reach the storing position (Step S4).

After the position of the end portion of the pushing unit 21 in the storage direction has reached the predetermined storing position, drive force that moves the pushing unit 21 toward the inner side in the storage direction is continually supplied. Therefore, inside the storing bag 600, the sheets 500 are compressed by the pushing unit 21. Note that the predetermined storing position is, for example, a position situated slightly closer to the inner side in the storage direction than be restricting unit 23.

Figure 23:
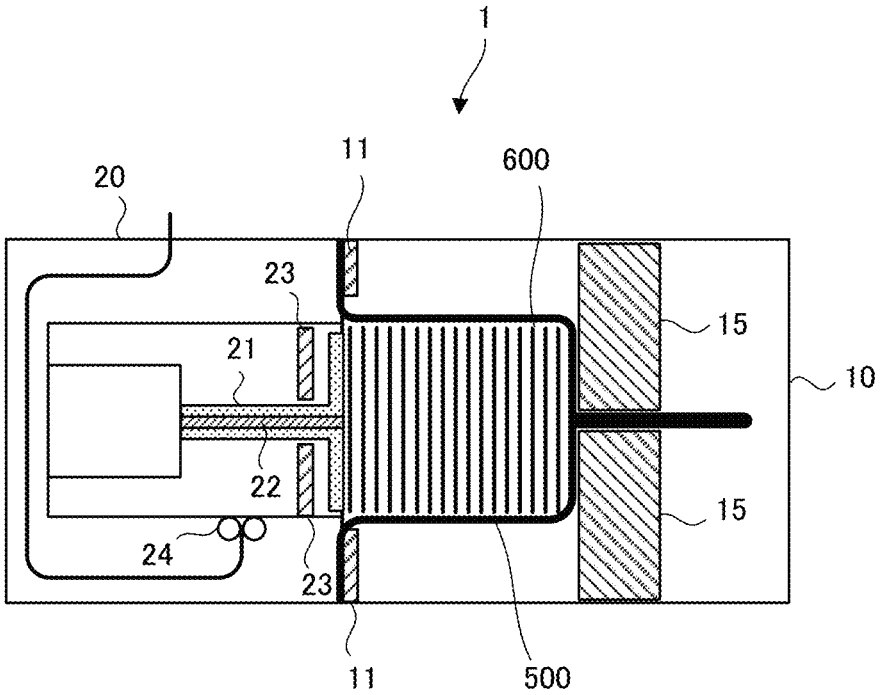
FIG. 23 shows an example of an operation of the sheet storage apparatus when storing the sheets in Embodiment 8.

After the position of the end portion of the pushing unit 21 in the storage direction has reached the predetermined storing position, the supply of drive force to the pushing unit 21 is stopped and the position of the pushing unit 21 in the storage direction is fixed. In this state, as shown in FIG. 23, the restricting unit 23 is closed (Step S5).

Figure 24:
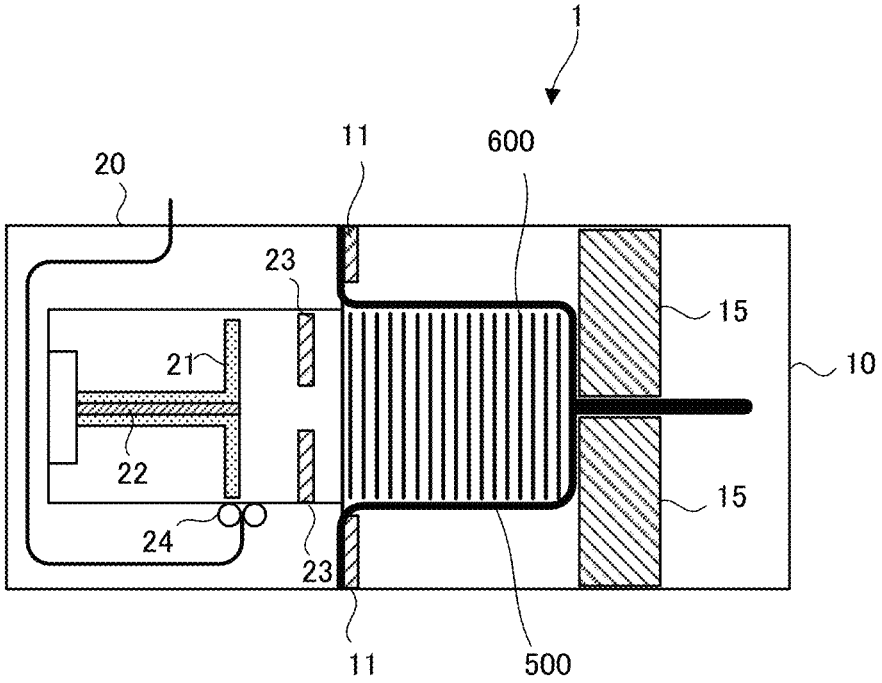
FIG. 24 shows an example of an operation of the sheet storage apparatus when storing the sheets in Embodiment 8.

As shown in FIG. 24, when the restricting unit 23 is closed, the entire pushing unit 21 passes through the gap of the restricting unit 23 and is returned toward the outer side in the storage direction (Step S6). Therefore, inside the storing bag 600, although the sheets 500 that are no longer subjected to compression force by the pushing unit 21 try to return to the outer side in the storage direction, the sheets 500 cannot return to an inner portion of the movement unit 20 due to the restricting unit 23. Consequently, the storing of the sheets into the storing bag 600 is completed.

Figure 25:
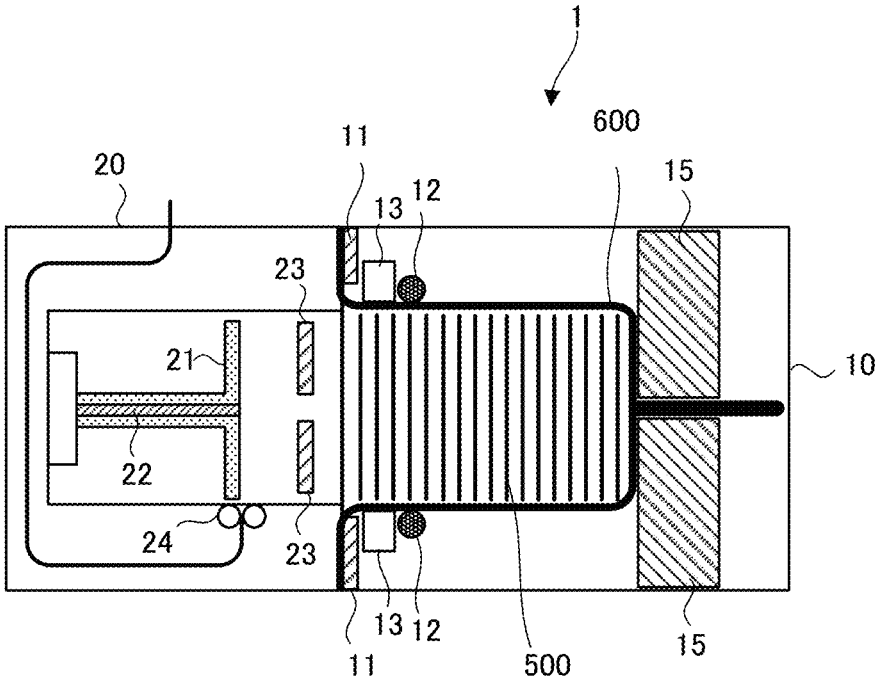
FIG. 25 shows an example of an operation of the sheet storage apparatus when sealing a storing bag in Embodiment 8.

FIGS. 25 to 31 show, according to steps, the operations of the sheet storage apparatus 1 when the storing bag 600 is to be sealed with the predetermined number of sheets 500 being stored in the storing bag 600. FIG. 25 shows a state in which the predetermined number of sheets 500 have been stored inside the storing bag 600 (STEP S11).

Figure 26:
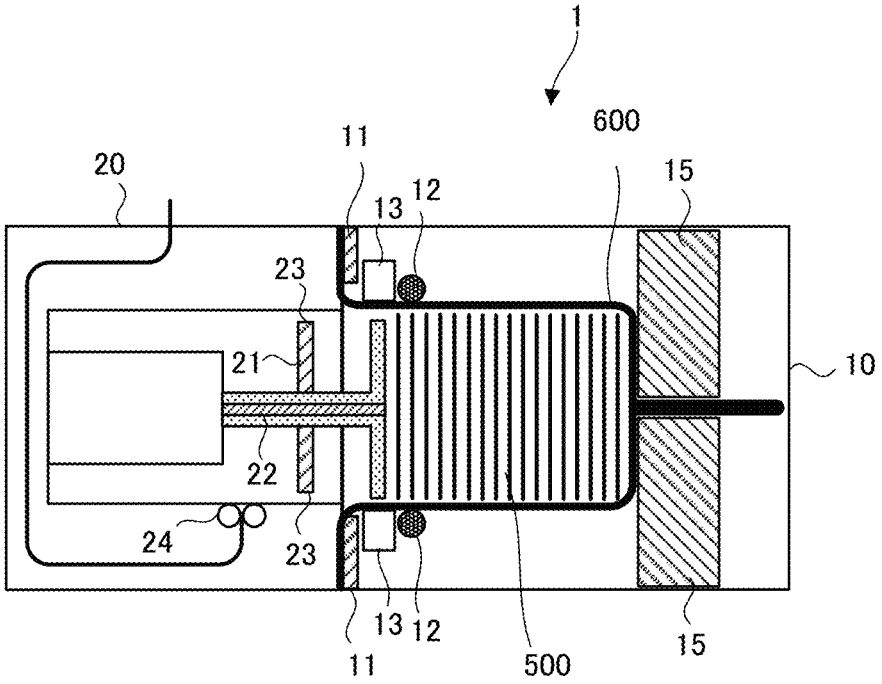
FIG. 26 shows an example of an operation of the sheet storage apparatus when sealing the storing bag in Embodiment 8.

First, as shown in FIG. 26, the pushing unit 21 and the holding unit 22 move together toward the inner side in the storage direction with the restricting unit 23 in a closed state (Step S12). Therefore, the sheets 500 that are stored inside the storing hag 600 are compressed by the pushing unit 21.

Figure 27:
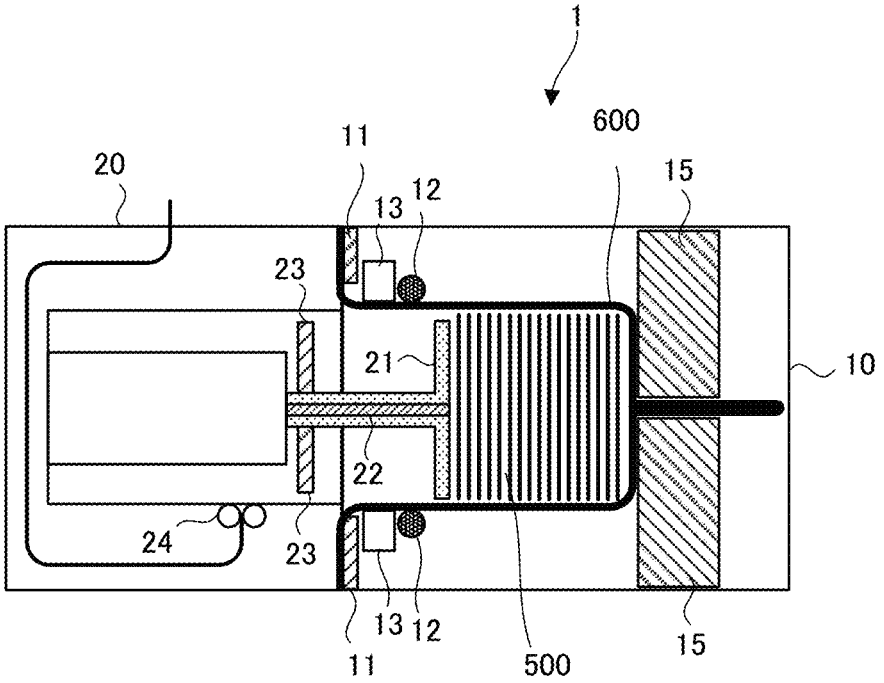
FIG. 27 shows an example of an operation of the sheet storage apparatus when sealing the storing bag in Embodiment 8.

The movement of the pushing unit 21 and the holding unit 22 toward the inner side in the storage direction is continued until the end portion of the pushing unit 21 reaches a predetermined sealing position. Note that, when the end portion of the pushing unit 21 cannot reach the sealing position due to the thickness of the sheets 500 stored inside the storing bag 600, the stage 15 moves toward the inner side in the storage direction to cause the end portion of the pushing unit 21 to reach the sealing position (Step S13). FIG. 27 shows a state in which the end portion of the pushing unit 21 has reached the sealing position. Note that the predetermined sealing position refers to a position situated closer to the inner side in the storage direction than the sealing units 13 and the closing units 12.

Figure 28:
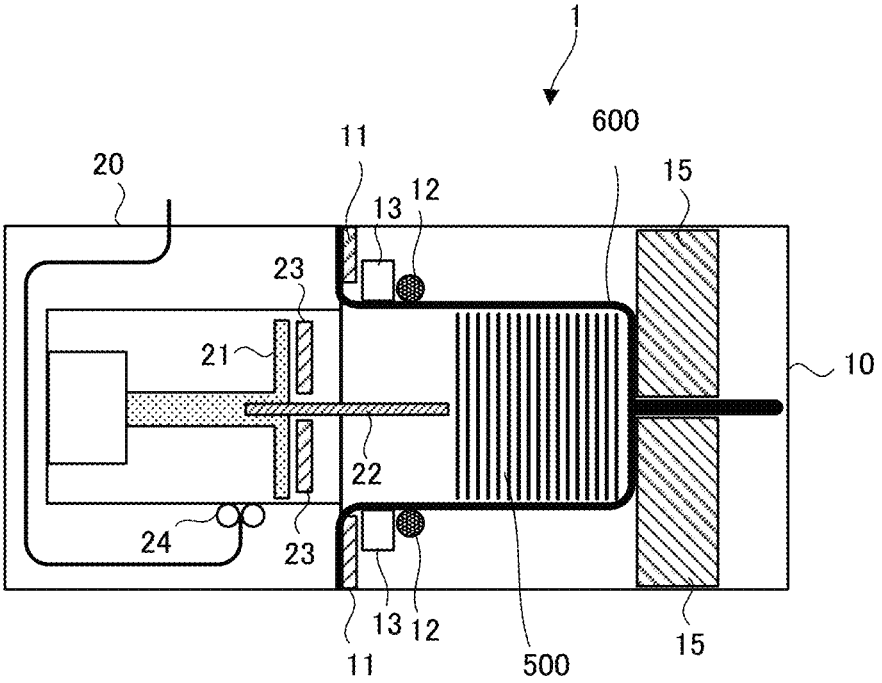
FIG. 28 shows an example of an operation of the sheet storage apparatus when sealing the storing bag in Embodiment 8.

When the end portion of the pushing unit 21 has reached to the sealing position, as shown in FIG. 28, an end portion of the holding unit 22 is fixed at the sealing position and the entire pushing unit 21 is returned up to the inner portion of the movement unit 20 (Step S14). Therefore, the sheets 500 are held by the holding unit 22. In Step S14, the pushing unit 21 may return up to the initial position of the pushing unit 21, or may be stopped at an appropriate position situated closer to the inner side in the storage direction than the initial position inside the movement unit 20.

Figure 29:
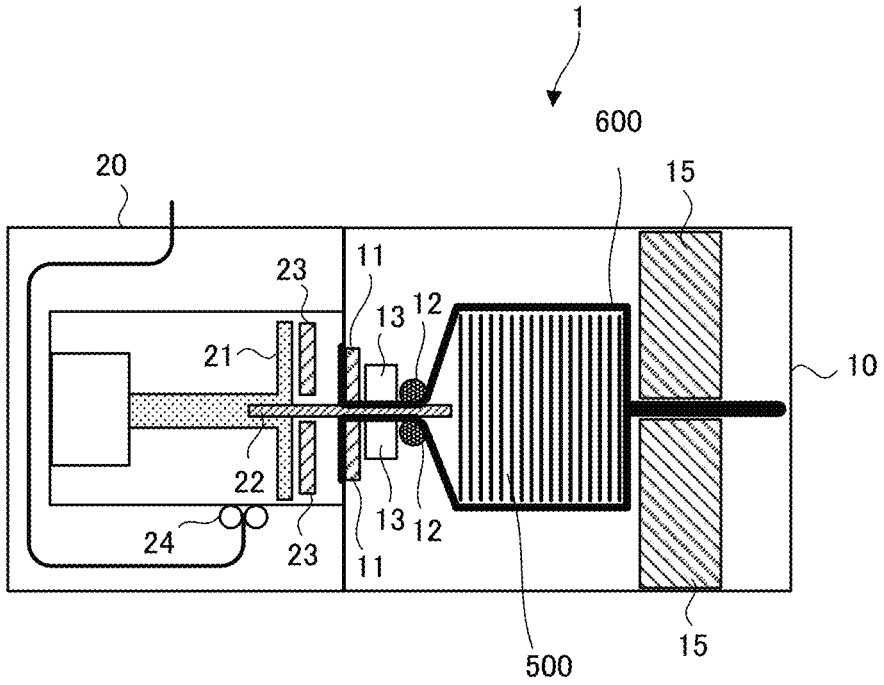
FIG. 29 shows an example of an operation of the sheet storage apparatus when sealing the storing bag in Embodiment 8.
Figure 30:
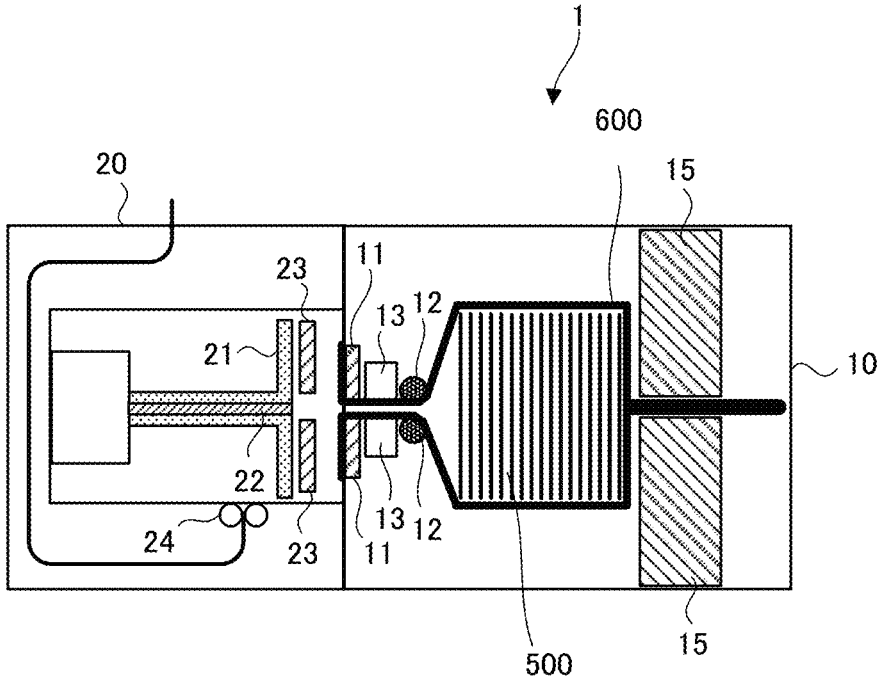
FIG. 30 shows an example of an operation of the sheet storage apparatus when sealing the storing bag in Embodiment 8.

As shown in FIG. 29, the closing units 12 close the storing bag 600 with the holding unit 22 holding the sheets 500 (Step S15). As shown in FIG. 30, the entire holding unit 22 is returned up to the inner portion of the movement unit 20 with the storing hag 600 closed by a certain amount (Step S16). Since the holding unit 22 is returned with the storing bag 600 being open by a certain amount, the sheets 500 are held by the inner surface of the storing bag 600 instead of by the holding unit 22. Therefore, the sheets 500 do not fall. The pushing unit 21 and the holding unit 22 are returned up to their initial positions, that is, a position situated at an outermost side in the storage direction in the movable region of the pushing unit 21 and a position situated at an outermost side in the storage direction in a movable region of the holding unit 22.

Figure 31:
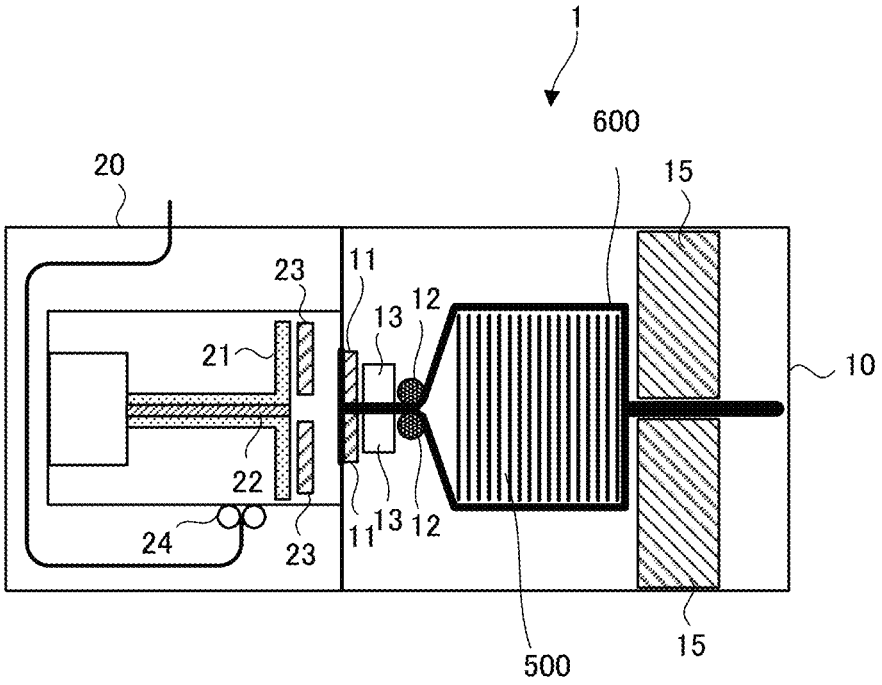
FIG. 31 shows an example of an operation of the sheet storage apparatus when sealing the storing hag in Embodiment 8.

Next, as shown in FIG. 31, the closing units 12 completely close the storing bag 600, and the sealing units 13 seal the entrance portion of the storing bag 600 (Step S17). Accordingly, the sealing of the storing bag 600 is completed.

After the sealing of the storing bag 600 is completed, a user draws out to the outside of the housing 101 the attachment unit 10 by using the slide unit 30 shown in FIG. 18. This makes it possible for the user to remove the storing bag 600 that has been sealed after storing the sheets 500 from the attachment unit 10 and to attach a new storing bag 600 to the attachment unit 10.

The invention claimed is:

1. A sheet storage apparatus comprising:

an attachment unit to which a storing bag for sheets is attached;

a holding unit that holds the sheets toward an inner side in a storage direction of the storing bag attached to the attachment unit, the sheets being stacked and stored in the storing bag; and a closing unit that closes an entrance of the storing bag by sandwiching the storing bag from outside thereof, wherein the closing unit comprises a first closing unit and a second closing unit, wherein the first closing unit and the second closing unit move simultaneously to close the entrance, wherein the first closing unit closes the entrance by moving from a first position to a second position, the first position being a position before the first closing unit starts sandwiching the storing bag, the second position being a position when the first closing unit sandwiches the storing bag together with the second closing unit, wherein the second closing unit closes the entrance by moving from a third position to a fourth position, the third position being a position before the second closing unit starts sandwiching the storing bag, the fourth position being a position when the second closing unit sandwiches the storing bag together with the first closing unit, wherein the first closing unit passes through a position closer to the inner side in the storage direction than the first position between moving from the first position to the second position, wherein the second closing unit passes through a position closer to the inner side in the storage direction than the third position between moving from the third position to the fourth position, and the first position and the third position are located on an outer side in the storage direction from a position where the holding unit that holds the sheet is in contact with the sheet.

2. The sheet storage apparatus according to claim 1, wherein the second position is situated at an innermost side in the storage direction among positions of the first closing unit from when the first closing unit starts sandwiching the storing bag to when the first closing unit completes sandwiching the storing bag, and the fourth position is situated at an innermost side in the storage direction among positions of the second closing unit from when the second closing unit starts sandwiching the storing bag to when the second closing unit completes sandwiching the storing bag.

3. The sheet storage apparatus according to claim 1, wherein the holding unit holds the sheets at an intermediate position in a direction in which the first closing unit and the second closing unit approach each other, and wherein, as the closing unit approaches the intermediate position, the closing unit moves toward the inner side in the storage direction.

4. The sheet storage apparatus according to claim 1, wherein the holding unit is a rod-shaped member or a plate-shaped member extending along the storage direction.

5. The sheet storage apparatus according to claim 4, wherein the holding unit is configured to hold down at least a portion excluding two end portions of the sheets that are stored in the storing bag.

6. The sheet storage apparatus according to claim 1, further comprising:

a sealing unit that is disposed closer to an outer side in the storage direction than the closing unit, and that sandwiches and seals the storing bag from the outside thereof with the entrance closed by the closing unit.

7. The sheet storage apparatus according to claim 6, wherein the closing unit and the sealing unit sandwich the storing bag by moving in response to each other.

8. The sheet storage apparatus according to claim 6, wherein the sealing unit comprises a first sealing unit and a second sealing unit, and wherein, when the sealing unit seals the storing bag, the first sealing unit and the second sealing unit move so as to approach each other, and sandwich the storing bag.

9. The sheet storage apparatus according to claim 6, wherein the sealing unit moves from a fifth position to a sixth position, the fifth position being a position before the sealing unit starts sandwiching the storing bag, the sixth position being a position when the sealing unit sandwiches the storing bag, and passes through a same position as the fifth position in the storage direction between moving from the fifth position to the sixth position.

10. The sheet storage apparatus according to claim 9, wherein the closing unit further comprises a covering unit that covers the sealing unit, and wherein the sealing unit is covered at the fifth position by the covering unit of the closing unit when the first closing unit is at the first position and the second closing unit is at the third position, and is exposed from the covering unit due to the first closing unit moving to the second position and the second closing unit moving to the fourth position in response to movement of the sealing unit toward the sixth position.

11. The sheet storage apparatus according to claim 6, further comprising:

a control unit that controls the closing unit and the sealing unit, wherein, when a distance between a position of the sealing unit in the storage direction and a position where the holding unit holds down the sheets is less than or equal to a threshold distance, the control unit causes sealing of the storing bag performed by using the closing unit and the sealing unit to be started.

12. The sheet storage apparatus according to claim 1, wherein the closing unit comprises a body portion that moves along a guide groove when sandwiching the storing bag.

13. The sheet storage apparatus according to claim 12, wherein the closing unit further comprises a contact portion that is engaged with the body portion, and wherein, when the closing unit sandwiches the storing bag, the contact portion comes into contact with the storing bag before the body portion comes into contact with the storing bag.

14. A sheet processing apparatus comprising:

a receiving unit that receives sheets; and the sheet storage apparatus according to claim 1 that stores the sheets that have been received.

15. The sheet storage apparatus according to claim 1, wherein when the first closing unit and the second closing unit close the entrance of the storage bag, the first closing unit and the second closing unit approach each other.

* * * * *